US010415241B2

(12) United States Patent
Simonson

(10) Patent No.: US 10,415,241 B2
(45) Date of Patent: Sep. 17, 2019

(54) MONOLITHIC RETAINING WALL

(71) Applicant: Excel Project Management Ltd., Golden (CA)

(72) Inventor: Robert Simonson, Golden (CA)

(73) Assignee: Excel Project Management Ltd., Golden (CA)

( * ) Notice: Subject to any disclaimer, the term of this patent is extended or adjusted under 35 U.S.C. 154(b) by 0 days.

(21) Appl. No.: 15/063,652

(22) Filed: Mar. 8, 2016

(65) Prior Publication Data

US 2017/0260743 A1 Sep. 14, 2017

(51) Int. Cl.

| | |
|---|---|
| ***E04B 2/40*** | (2006.01) |
| ***E02D 29/02*** | (2006.01) |
| ***E04B 1/04*** | (2006.01) |
| ***E04C 1/39*** | (2006.01) |
| ***E04C 5/01*** | (2006.01) |
| ***E04B 2/32*** | (2006.01) |
| *E04B 2/02* | (2006.01) |

(52) U.S. Cl.

CPC ..... *E04B 2/40* (2013.01); *E02D 29/0266* (2013.01); *E04B 1/043* (2013.01); *E04B 2/32* (2013.01); *E04C 1/395* (2013.01); *E04C 1/397* (2013.01); *E04C 5/01* (2013.01); *E04B 2002/0204* (2013.01); *E04B 2002/0221* (2013.01); *E04B 2002/0263* (2013.01)

(58) Field of Classification Search

CPC ... E04B 2/40; E04B 2/34; E04B 1/043; E02D 29/0266; E04C 1/397; E04C 5/01

See application file for complete search history.

(56) References Cited

U.S. PATENT DOCUMENTS

| | | | |
|---|---|---|---|
| 1,992,785 | A | 2/1935 | Steuer |
| 3,233,379 | A | 2/1966 | Zagray |

(Continued)

FOREIGN PATENT DOCUMENTS

| | | | |
|---|---|---|---|
| CA | 1203395 | A | 4/1986 |
| CN | 204059659 | U | 12/2014 |

(Continued)

OTHER PUBLICATIONS

Lock-Block Ltd.; "Lock-BlockTM Units"; available online: http://www.lockblock.com/; 2014; 4 pages.

(Continued)

*Primary Examiner* — Paola Agudelo

(74) *Attorney, Agent, or Firm* — Miltons IP/p.i.

(57) ABSTRACT

An apparatus includes a monolithic retaining wall formed by combinable modular retaining wall blocks. Each of the combinable modular retaining wall blocks defines (A) vertical grooves extending along a vertical direction, and (B) horizontal grooves extending along a horizontal direction. This is done in such a way that the monolithic retaining wall, which is formed by the combinable modular retaining wall blocks, defines (A) spaced-apart instances of the vertical channels extending vertically through the monolithic retaining wall, and (B) spaced-apart instances of the horizontal channels extending horizontally through the monolithic retaining wall, in which at least some of the spaced-apart instances of the horizontal channels intersect at least some of the spaced-apart instances of the vertical channels.

21 Claims, 39 Drawing Sheets

(56) References Cited

U.S. PATENT DOCUMENTS

| | | | | |
|---|---|---|---|---|
| 3,534,518 | A * | 10/1970 | Zagray | E04B 2/46 52/258 |
| 4,110,949 | A | 9/1978 | Cambiuzzi et al. | |
| 4,573,301 | A * | 3/1986 | Wilkinson | E04B 2/18 52/220.2 |
| 4,590,729 | A | 5/1986 | Hegazi | |
| 5,421,135 | A | 6/1995 | Stevens et al. | |
| 5,586,841 | A | 12/1996 | Anderson et al. | |
| 5,623,797 | A | 4/1997 | Gravier et al. | |
| 5,794,921 | A | 8/1998 | Greenberg | |
| 5,890,332 | A | 4/1999 | Skidmore et al. | |
| 5,904,019 | A | 5/1999 | Kooij et al. | |
| 5,921,715 | A | 7/1999 | Rainey | |
| 6,065,263 | A * | 5/2000 | Taguchi | E04B 5/023 403/305 |
| 6,088,987 | A | 7/2000 | Simmons et al. | |
| 6,089,792 | A | 7/2000 | Khamis | |
| 6,161,357 | A | 12/2000 | Altemus | |
| 6,397,549 | B1 | 6/2002 | Baldwin | |
| 6,557,818 | B2 | 5/2003 | Manthei | |
| 6,588,168 | B2 * | 7/2003 | Walters | E04B 2/14 52/604 |
| 6,615,561 | B2 | 9/2003 | MacDonald et al. | |
| 6,857,240 | B1 | 2/2005 | MacAlister | |
| 7,328,537 | B2 | 2/2008 | Hammer | |
| 7,934,345 | B2 | 5/2011 | Marsh et al. | |
| 7,934,351 | B2 | 5/2011 | Clarno | |
| 8,099,918 | B2 | 1/2012 | Marsh et al. | |
| 8,171,693 | B2 | 5/2012 | Banova | |
| 8,549,811 | B2 * | 10/2013 | Dyson | E04B 2/48 52/437 |
| 8,820,024 | B1 * | 9/2014 | Abdullah | E04B 2/08 52/561 |
| 8,887,469 | B2 | 11/2014 | MacDonald et al. | |
| 9,206,597 | B2 | 12/2015 | Marsh et al. | |
| 9,238,910 | B2 * | 1/2016 | Jensen | E04B 2/44 |
| 9,315,992 | B2 | 4/2016 | Carey | |
| 2002/0001509 | A1 | 1/2002 | Hong | |
| 2002/0083658 | A1 * | 7/2002 | Dial, Jr. | B22C 9/24 52/125.4 |
| 2003/0126809 | A1 * | 7/2003 | Hampton | B28B 7/0044 52/125.4 |
| 2004/0237445 | A1 | 12/2004 | Kliethermes | |
| 2005/0108972 | A1 * | 5/2005 | Banova | E04B 2/44 52/596 |
| 2005/0252123 | A1 * | 11/2005 | Colonias | E04C 5/06 52/295 |
| 2008/0098687 | A1 | 5/2008 | Marsh et al. | |
| 2008/0256894 | A1 | 10/2008 | Marsh et al. | |
| 2009/0113835 | A1 * | 5/2009 | Banova | E04B 2/30 52/604 |
| 2009/0151292 | A1 * | 6/2009 | Sinclair, Sr. | E04B 2/02 52/596 |
| 2013/0036696 | A1 | 2/2013 | Moroschan | |
| 2014/0223848 | A1 * | 8/2014 | Binhussain | E04B 2/18 52/309.17 |

FOREIGN PATENT DOCUMENTS

| | | | |
|---|---|---|---|
| DE | 3319645 | A1 | 12/1984 |
| EP | 2894270 | A1 | 7/2015 |
| JP | H0679914 | U | 11/1994 |

OTHER PUBLICATIONS

World Block: Knob Style; "30×30×60"; available online: http://www.worldblock.com/; 5 pages.

Langley Concrete Group; "Highway Barriers and Parking Curbs" available online: http://www.langleyconcrete.calls.net/index.php?mact=Gallery,m6e73e,default,1&m6e73edir=Headwall%; 3 pages.

Evaluation Report No. 198; Allan Block Retaining Wall Systems; available online: http://www.allanblock.com/literature/PDF/ER_0198.pdf; Sep. 30, 2011; Revised Sep. 18, 2015; 16 pages.

Redi-Rock; "Concrete Retaining Wall System Freestanding Walls"; available online: https://www.redi-rock.com/concrete-block-systems-to-build-freestanding-walls.htm; 3 pages.

Formablok; "Build-your-own Concrete Blocks"; available online: http://www.formablok.com/; 1 page.

ConcreteNetwork.com; "Molds & Mold Rubbers in USA and Worldwide"; available online: http://www.concretenetwork.com/suppliers/MoldsMoldRubbers/usa-and-canada/; 1 page.

Europe Block; "Concrete Block Moulds"; available online: http://www.europeblock.com/en/concrete-block-moulds/?gclid=CPqcjJLjucMCFQinaQodGFwAdg; 1 page.

World Block: "V-Interlock"; available online: http://www.worldblock.com/v-interlock.html; 9 pages.

LMI—Leonard Marr, Inc.; "Blocks and Molds"; available online: http://www.leonardmarrinc.com/blocks_and_molds.html; 2 pages.

LMI—Leonard Marr, Inc. Brochure; "Interlocking Concrete Block Forms"; available online: http://www.leonardmarrinc.com/images/Full_Brochure.pdf; 16 pages.

Concrete Mixer Supply: "CF1000 Concrete Block Forms 2 Piece 2'×2'×6"; available online: http://www.concretemixersupply.com/parts/cf1000-3/; 3 pages.

Alibaba; "QMR2-40 Channel Brick Making Machine, U Shape Brick Making Machine"; available online: http://www.alibaba.com/product-detail/QMR2-40-Channel-Brick-Making-Machine_1877522391.html?spm=a2700.7724857.29.66.0nBNfC; 3 pages.

* cited by examiner

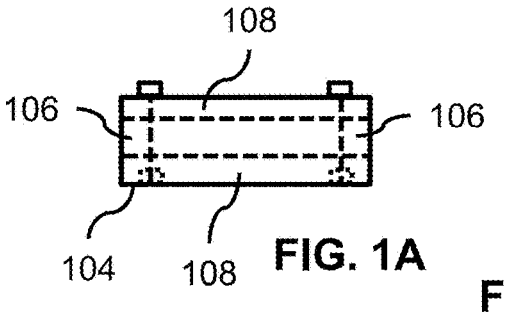
FIG. 1A
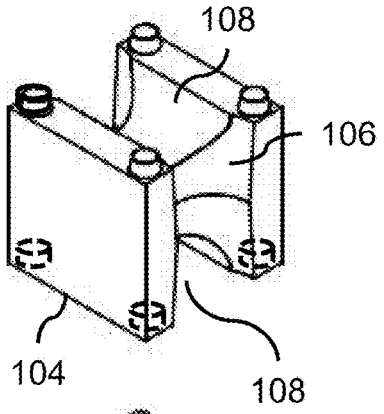
FIG. 1B
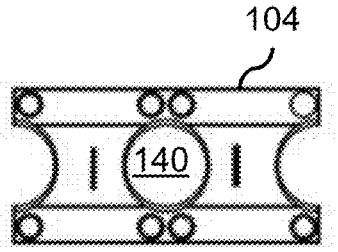
FIG. 2
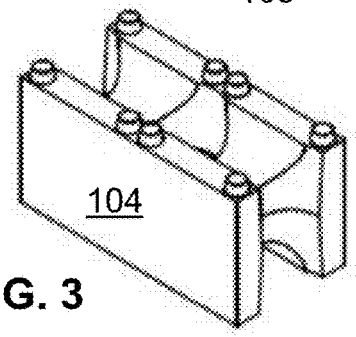
FIG. 3
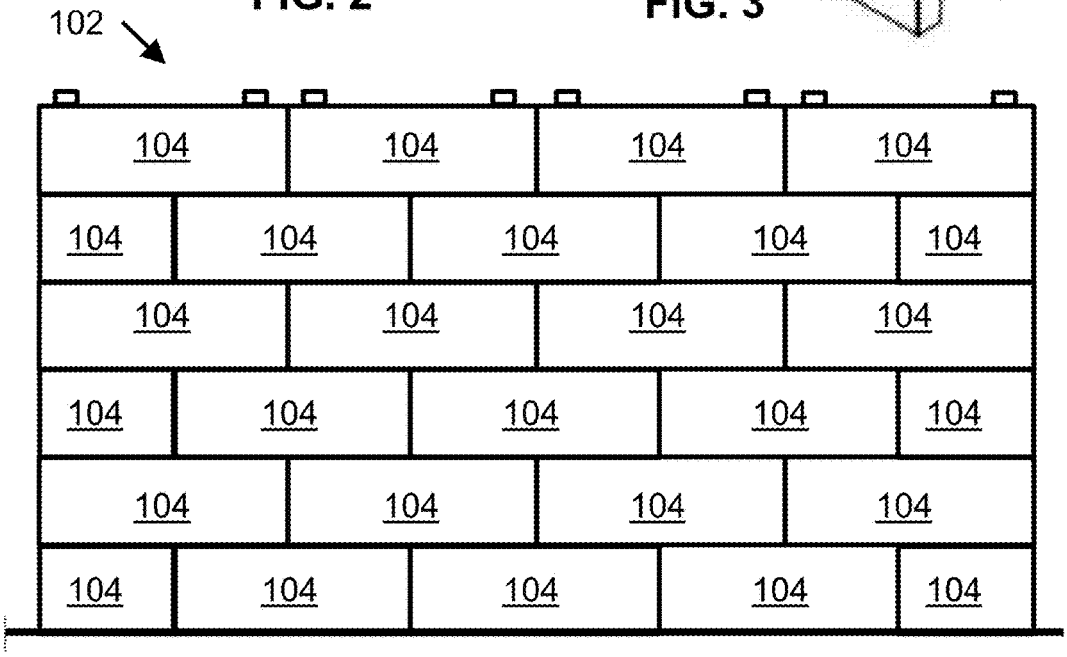
102
104
104
104

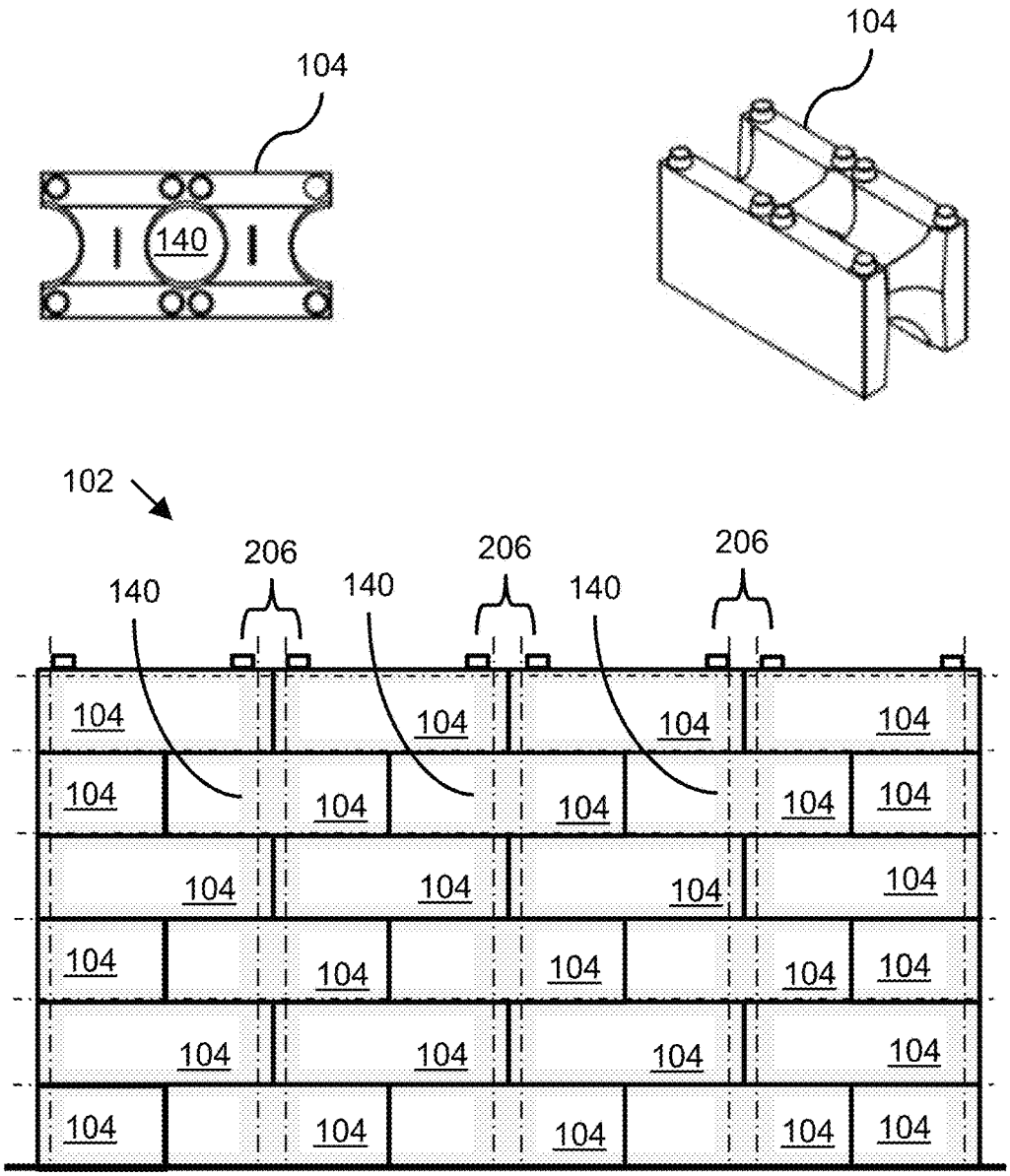
104
140
104
102
206
206
206
140
140
140
104
104
104

MONOLITHIC RETAINING WALL

TECHNICAL FIELD

This document relates to the technical field of (and is not limited to) an apparatus 100 including, and not limited to, (A) a monolithic retaining wall formed by combinable modular retaining wall blocks, (B) combinable modular retaining wall blocks configured to form, in combination, a monolithic retaining wall, and (C) a method of constructing a monolithic retaining wall.

BACKGROUND

Retaining walls are structures configured to restrain soil to unnatural slopes. They are used to bound soils between two different elevations often in areas of terrain possessing undesirable slopes or in areas where the landscape needs to be shaped severely and engineered for more specific purposes like hillside farming or roadway overpasses.

A retaining wall is a structure designed and constructed to resist the lateral pressure of soil when there is a desired change in ground elevation that exceeds the angle of repose of the soil.

A basement wall is thus one kind of retaining wall. But, the term usually refers to a cantilever retaining wall, which is a freestanding structure without lateral support at its top. The retaining wall is cantilevered from a footing and rises above the grade on one side to retain a higher level grade on the opposite side. The retaining wall must resist the lateral pressures generated by loose soils or, in some cases, water pressures. etc.

A retaining wall is configured to support a wedge of soil. The wedge is defined as the soil which extends beyond the failure plane of the soil type present at the wall site, and can be calculated once the soil friction angle is known. As the setback of the wall increases, the size of the sliding wedge is reduced. This reduction lowers the pressure on the retaining wall.

The most important consideration in proper design and installation of retaining walls is to recognize and counteract the tendency of the retained material to move downslope due to gravity. This creates lateral earth pressure behind the wall which depends on the angle of internal friction (phi) and the cohesive strength (c) of the retained material, as well as the direction and magnitude of movement that the retaining structure undergoes.

Lateral earth pressures are zero at the top of the wall and—in homogenous ground—increase proportionally to a maximum value at the lowest depth. Earth pressures will push the wall forward or overturn it if not properly addressed. Also, any groundwater behind the wall that is not dissipated by a drainage system causes hydrostatic pressure on the wall. The total pressure or thrust may be assumed to act at one-third from the lowest depth for lengthwise stretches of uniform height.

Unless the wall is designed to retain water, it is important to have proper drainage behind the wall in order to limit the pressure to the wall's design value. Drainage materials will reduce or eliminate the hydrostatic pressure and improve the stability of the material behind the wall. Drystone retaining walls are normally self-draining.

As an example, the International Building Code requires retaining walls to be designed to ensure stability against overturning, sliding, excessive foundation pressure and water uplift; and that they be designed for a safety factor of 1.5 (no units) against lateral sliding and overturning.

SUMMARY

It will be appreciated that there exists a need to mitigate (at least in part) at least one problem associated with the existing retaining walls (also called the existing technology). After much study of the known systems and methods with experimentation, an understanding of the problem and its solution has been identified and is articulated as follows:

Existing retaining walls do not provide sufficient strength of configuration and/or configuration flexibility, and this situation limits the types of retaining walls that may be designed or configured to suit a specific application. What is needed is a solution to this problem.

To mitigate, at least in part, at least one problem associated with the existing technology, there is provided (in accordance with a major aspect) an apparatus. The apparatus includes (and is not limited to) a monolithic retaining wall formed by combinable modular retaining wall blocks. Each of the combinable modular retaining wall blocks defines (A) vertical grooves extending along a vertical direction, and (B) the horizontal grooves extending along a horizontal direction. This is done in such a way that the monolithic retaining wall (which is formed by the combinable modular retaining wall blocks) defines (A) spaced-apart instances of the vertical channels extending vertically through the monolithic retaining wall, and (B) spaced-apart instances of the horizontal channels extending horizontally through the monolithic retaining wall, in which at least some of the spaced-apart instances of the horizontal channels intersect at least some of the spaced-apart instances of the vertical channels.

A rebar cage structure is installed in (A) the spaced-apart instances of the vertical channels defined by the monolithic retaining wall, and (B) the spaced-apart instances of the horizontal channels defined by the monolithic retaining wall, and this is done in such a way that the rebar cage structure extends, at least in part, along at least some of (A) the spaced-apart instances of the vertical channels defined by the monolithic retaining wall, and (B) the spaced-apart instances of the horizontal channels defined by the monolithic retaining wall.

Hardened concrete is bonded with at least some of the rebar cage structure that is positioned in (A) the spaced-apart instances of the vertical channels defined by the monolithic retaining wall, and (B) the spaced-apart instances of the horizontal channels defined by the monolithic retaining wall. The hardened concrete is bonded with at least some of the combinable modular retaining wall blocks forming the monolithic retaining wall, in which the hardened concrete was formed by: (A) pouring the concrete slurry into the spaced-apart instances of the vertical channels defined by the monolithic retaining wall and also into the spaced-apart instances of the horizontal channels defined by the monolithic retaining wall in which the rebar cage structure is installed therein, and (B) allowing the concrete slurry to harden in (i) the spaced-apart instances of the vertical channels defined by the monolithic retaining wall, and (ii) the spaced-apart instances of the horizontal channels defined by the monolithic retaining wall in which the rebar cage structure is installed therein.

The hardened concrete, which is bonded with (A) the combinable modular retaining wall blocks forming the monolithic retaining wall, and (B) the rebar cage structure that is positioned in the spaced-apart instances of the vertical channels of the monolithic retaining wall, in combination with the rebar cage structure are configured to bear, in use, the application of a combination of (a) a compressive force to the hardened concrete as a result of the weight of the combinable modular retaining wall blocks installed in the monolithic retaining wall, and (b) a vertical tension force to the hardened concrete in which the vertical tension force is a result of the weight of soil bearing against the monolithic retaining wall, in which the vertical tension force is applicable along the vertical direction extending vertically through the combinable modular retaining wall blocks that form the monolithic retaining wall.

The hardened concrete, which is bonded with (A) the combinable modular retaining wall blocks forming the monolithic retaining wall, and (B) the rebar cage structure that is positioned in the spaced-apart instances of the horizontal channels of the monolithic retaining wall, in combination with the rebar cage structure are is configured to bear, in use, a horizontal tension force as a result of the weight of soil bearing against the monolithic retaining wall along the horizontal direction extending horizontally through the combinable modular retaining wall blocks that form the monolithic retaining wall.

To mitigate, at least in part, at least one problem associated with the existing technology, there is provided (in accordance with a major aspect) an apparatus. The apparatus includes (and is not limited to) combinable modular retaining wall blocks configured to form, in combination, a monolithic retaining wall. Each of the combinable modular retaining wall blocks defines (A) vertical grooves extending along a vertical direction, and (B) the horizontal grooves extending along a horizontal direction. The combinable modular retaining wall blocks are configured to form, in combination, the monolithic retaining wall in such a way that the monolithic retaining wall defines (A) spaced-apart instances of the vertical channels extending vertically through the monolithic retaining wall, and (B) spaced-apart instances of the horizontal channels extending horizontally through the monolithic retaining wall, in which at least some of the spaced-apart instances of the horizontal channels intersect at least some of the spaced-apart instances of the vertical channels.

The combinable modular retaining wall blocks are configured to form, in combination, the monolithic retaining wall in such a way that a rebar cage structure is installable in (A) the spaced-apart instances of the vertical channels defined by the monolithic retaining wall, and (B) the spaced-apart instances of the horizontal channels defined by the monolithic retaining wall, and this is done in such a way that the rebar cage structure extends, at least in part, along at least some of (A) the spaced-apart instances of the vertical channels defined by the monolithic retaining wall, and (B) the spaced-apart instances of the horizontal channels defined by the monolithic retaining wall.

The combinable modular retaining wall blocks are configured to form, in combination, the monolithic retaining wall in such a way that hardened concrete is bondable with at least some of the rebar cage structure that is positioned in (A) the spaced-apart instances of the vertical channels defined by the monolithic retaining wall, and (B) the spaced-apart instances of the horizontal channels defined by the monolithic retaining wall.

The hardened concrete is bondable with at least some of the combinable modular retaining wall blocks forming the monolithic retaining wall, in which the hardened concrete was formed by: (A) pouring a concrete slurry into the spaced-apart instances of the vertical channels defined by the monolithic retaining wall and also into the spaced-apart instances of the horizontal channels defined by the monolithic retaining wall in which the rebar cage structure is installed therein, and (B) allowing the concrete slurry to harden in (i) the spaced-apart instances of the vertical channels defined by the monolithic retaining wall, and (ii) the spaced-apart instances of the horizontal channels defined by the monolithic retaining wall in which the rebar cage structure is installed therein.

The hardened concrete, which is bonded with (A) the combinable modular retaining wall blocks forming the monolithic retaining wall, and (B) the rebar cage structure that is positioned in the spaced-apart instances of the vertical channels of the monolithic retaining wall, in combination with the rebar cage structure are configured to bear, in use, the application of a combination of (a) a compression force to the hardened concrete as a result of the weight of the combinable modular retaining wall blocks installed in the monolithic retaining wall, and (b) the vertical tension force as a result of the weight of soil bearing against the monolithic retaining wall, in which the vertical tension force is applicable along the vertical direction extending vertically through the combinable modular retaining wall blocks that form the monolithic retaining wall.

The hardened concrete, which is bonded with (A) the combinable modular retaining wall blocks forming the monolithic retaining wall, and (B) the rebar cage structure that is positioned in the spaced-apart instances of the horizontal channels of the monolithic retaining wall, in combination with the rebar cage structure are configured to bear, in use, a horizontal tension force as a result of the weight of soil bearing against the monolithic retaining wall along the horizontal direction extending horizontally through the combinable modular retaining wall blocks that form the monolithic retaining wall.

To mitigate, at least in part, at least one problem associated with the existing technology, there is provided (in accordance with a major aspect) a method of constructing a monolithic retaining wall. The method includes (and is not limited to) spatially positioning the combinable modular retaining wall blocks in such a way that the combinable modular retaining wall blocks form the monolithic retaining wall relative to a working surface. Each of the combinable modular retaining wall blocks define (A) vertical grooves extending along a vertical direction, and (B) the horizontal grooves extending along a horizontal direction, and this is done in such a way that the monolithic retaining wall (which is formed by the combinable modular retaining wall blocks) defines (i) spaced-apart instances of the vertical channels extending vertically through the monolithic retaining wall, and (ii) spaced-apart instances of the horizontal channels extending horizontally through the monolithic retaining wall, in which at least some of the spaced-apart instances of the horizontal channels intersect at least some of the spaced-apart instances of the vertical channels extending vertically through the monolithic retaining wall.

The method further includes installing a rebar cage structure in (A) the spaced-apart instances of the vertical channels defined by the monolithic retaining wall, and (B) the spaced-apart instances of the horizontal channels defined by the monolithic retaining wall, and this is done in such a way that the rebar cage structure extends, at least in part, along at least some of (A) the spaced-apart instances of the vertical channels defined by the monolithic retaining wall, and (B) the spaced-apart instances of the horizontal channels defined by the monolithic retaining wall.

The method further includes forming the monolithic retaining wall by pouring a concrete slurry into the spaced-apart instances of the vertical channels defined by the monolithic retaining wall and also into the spaced-apart instances of the horizontal channels defined by the monolithic retaining wall in which the rebar cage structure is installed, at least in part, therein.

The method further includes waiting for the concrete slurry to harden into hardened concrete in such a way that the hardened concrete becomes bonded with at least some of (A) the combinable modular retaining wall blocks forming the monolithic retaining wall, and (B) the rebar cage structure that is positioned in (i) the spaced-apart instances of the vertical channels defined by the monolithic retaining wall, and (ii) the spaced-apart instances of the horizontal channels defined by the monolithic retaining wall.

The method further includes waiting for the concrete slurry to harden into hardened concrete in such a way that the hardened concrete (which becomes bonded with at least some of (A) the combinable modular retaining wall blocks forming the monolithic retaining wall, and (B) the rebar cage structure that is positioned in the spaced-apart instances of the vertical channels of the monolithic retaining wall) in combination with the rebar cage structure are configured to bear, in use, application of a combination of (a) the compressive force to the hardened concrete as a result of the weight of the combinable modular retaining wall blocks installed in the monolithic retaining wall, and (b) the vertical tension force to the hardened concrete, in which the vertical tension force is a result of the weight of soil bearing against the monolithic retaining wall. The vertical tension force is applicable along the vertical direction extending vertically through the combinable modular retaining wall blocks that form the monolithic retaining wall.

The method further includes waiting for the concrete slurry to harden into hardened concrete in such a way that the hardened concrete, which becomes bonded with at least some of (A) the combinable modular retaining wall blocks forming the monolithic retaining wall, and (B) the rebar cage structure that is positioned in the spaced-apart instances of the horizontal channels of the monolithic retaining wall, in combination with the rebar cage structure are configured to bear, in use, a horizontal tension force as a result of the weight of soil bearing against the monolithic retaining wall along the horizontal direction extending horizontally through the combinable modular retaining wall blocks that form the monolithic retaining wall.

In accordance with a preferred embodiment, in instances where due to the height of the monolithic retaining wall or the nature of the soil being retained, the horizontal tension force (horizontal force) may exceed the capacity of the monolithic retaining wall to contain the horizontal tension force, and it may be necessary to provide resistance to movement or tipping. Horizontal movement of the base of the wall may be prevented by using a number of methods. The base row of the blocks may be buried into the soil (if so desired). The wall may be set on pilings driven or drilled into the ground and extending into the vertical channels or the soil may be piled against the base of the wall. These or other methods may be used to increasing the horizontal tension force required to cause the wall to move horizontally. Where the height of the wall may cause the horizontal tension force to be greater that the resistance to it caused by the weight of the wall, a number of methods exist to overcome the horizontal tension force. A perpendicular wall section may be introduce space along the wall and extending far enough back to act as a counterweight. The capacity of the perpendicular wall segment may be increased by installing the blocks including the perpendicular segment over pilings that extend into the vertical channels. Alternatively, tie back anchors may be cast into the blocks, and the soil anchors a massive concrete "dead man", or a parallel instance of the monolithic retaining wall may be attached to the tie back anchors, etc. A number of other methods of anchoring the wall is evident to someone skilled in the art of building retaining walls.

Other aspects are identified in the claims.

Other aspects and features of the non-limiting embodiments may now become apparent to those skilled in the art upon review of the following detailed description of the non-limiting embodiments with the accompanying drawings.

This Summary is provided to introduce concepts in simplified form that are further described below in the Detailed Description. This Summary is not intended to identify key features or essential features of the disclosed or claimed subject matter, and is not intended to describe each disclosed embodiment or every implementation of the disclosed or claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which:

FIG. 1A, 1B, FIG. 2 and FIG. 3 depict views of embodiments of an apparatus including embodiments of combinable modular retaining wall blocks;

FIG. 4, FIG. 5, FIG. 6, FIG. 7A, FIG. 7B, and FIG. 8 depict views of embodiments of an apparatus including an embodiment of a monolithic retaining wall formed by the combinable modular retaining wall block of FIG. 1A and/or FIG. 2;

Figure 5:
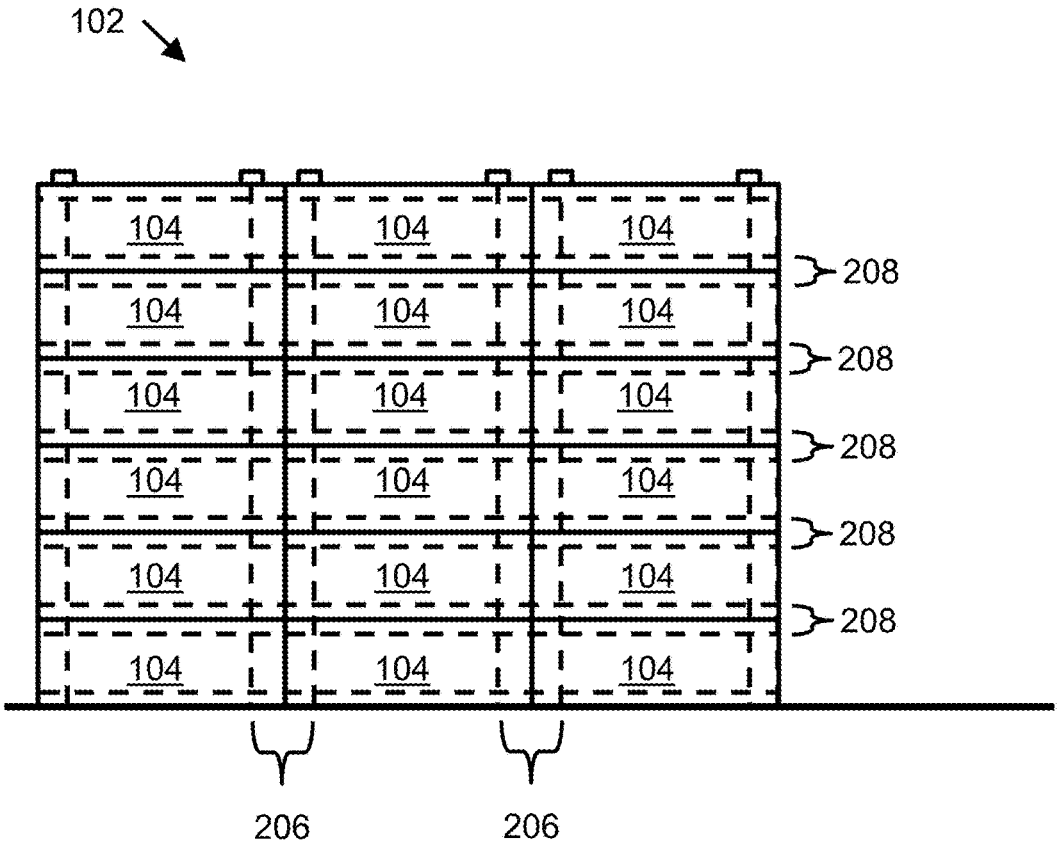

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 apparatus
102 monolithic retaining wall, or wall
104 combinable modular retaining wall block, block, or blocks
106 vertical groove, or vertical grooves
108 horizontal groove, or horizontal grooves
110 rebar cage structure
112 hardened concrete
114 vertical rebars
116 horizontal rebars
118 utility pipe
120 first interlocking feature
122 second interlocking feature
124 lifting loop
126 semi-circular void
128 fence post hole
130 first lateral side face
132 second lateral side face
134 sloped end surface
136 capped void
138 end cap
140 vertical passageway
142 metal reinforcing cage
144 horizontally aligned anchor tube
146 take-off section
148 outer face wall
150 intermediate arched block
152 upper arch block
154 key block
156 block side angle
158 full slot
160 half slot
162 angle
200 compression force
201 vertical tension force
202 horizontal tension force
206 vertical channels
208 horizontal channels
900 soil
902 form, or forms
904 connectors
906 tie

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the invention is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise.

It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1A, 1B, FIG. 2 and FIG. 3 depict views of embodiments of an apparatus 100 including combinable modular retaining wall blocks 104. FIG. 1A depicts a side view of the block 104 in accordance with a first embodiment. FIG. 2 depicts a perspective view of the block 104 of FIG. 1A. FIG. 2 depicts a side view of the block 104 in accordance with a second embodiment. FIG. 3 depicts a perspective view of the block 104 of FIG. 3.

Referring to the embodiments as depicted in FIGS. 1A, 1B, 2 and 3, the apparatus 100 includes (and is not limited to) the combinable modular retaining wall blocks 104. At least some of the combinable modular retaining wall blocks 104 are configured to form, in combination, the monolithic retaining wall 102 (as depicted in the embodiments of FIGS. 4 to 7A and 7B). In accordance with a preferred embodiment, the monolithic retaining wall 102 includes only the instances of the combinable modular retaining wall blocks 104 (and no other type of blocks are used).

Referring to the embodiments as depicted in FIGS. 1A and 1B, the block 104 includes a half block configuration that does not define a vertical passageway extending therethrough.

Referring to the embodiments as depicted in FIGS. 2 and 3, the block 104 includes a full block configuration that defines a vertical passageway 140 that extends from top to bottom sides of the block 104.

It will be appreciated that any one of the embodiments of the block 104 (as depicted in FIGS. 1 to 2 and 10 to 127) may be utilized (included) in any one of the embodiments of the wall 102 (as depicted in FIGS. 4 to 9), as may be required to suit a specific design and/or installation requirement. It will be appreciated that the embodiments of the block 104 as depicted in FIGS. 1-2 and 10 to 127 may be mixed and matched (combined) as may be required in order to form any one of the embodiments of the wall 102 (as depicted in FIGS. 4 to 9) or other shapes and/or forms of the wall 102 as may be required to build for a specific installation.

The combinable modular retaining wall blocks 104 is hereafter referred to as the blocks 104 (for ease of description of the apparatus 100).

Each of (or at least some of) the blocks 104 defines, at least in part, (A) vertical grooves 106 extending along a vertical direction, and (B) the horizontal grooves 108 extending along a horizontal direction. At least some of (more preferably, all of) the blocks 104 are configured to form, in combination, the monolithic retaining wall 102 (as explained in accordance with the description associated with FIGS. 4 to 7A and 7B).

Preferably, the blocks 104 are manufactured by a brick-molding system (known and not depicted) that is configured to use a mold assembly (known and not depicted) forming an interior cavity for receiving the concrete slurry therein. The mold assembly is configured to form the instances of the combinable modular retaining wall blocks 104.

FIG. 4, FIG. 5, FIG. 6, FIG. 7A, FIG. 7B, and FIG. 8 depict views of embodiments of an apparatus 100 including a monolithic retaining wall 102 formed by the blocks 104 of FIG. 1A and/or FIG. 2. FIG. 4, FIG. 5, FIG. 6, FIG. 7A and FIG. 7B depict frontal views.

Figure 7A:
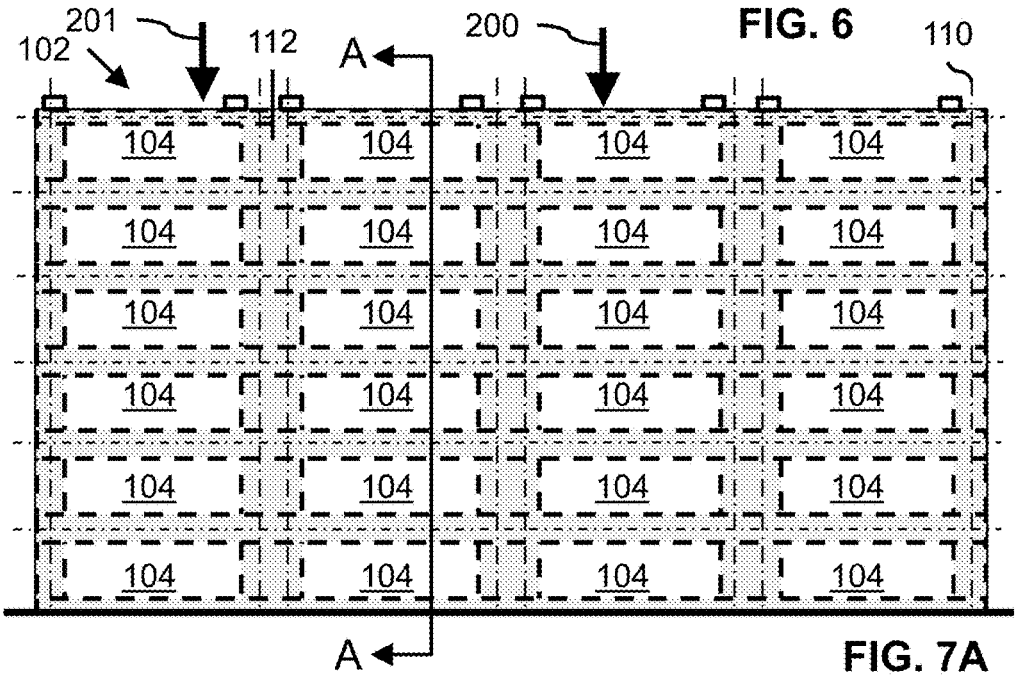
Figure 8:
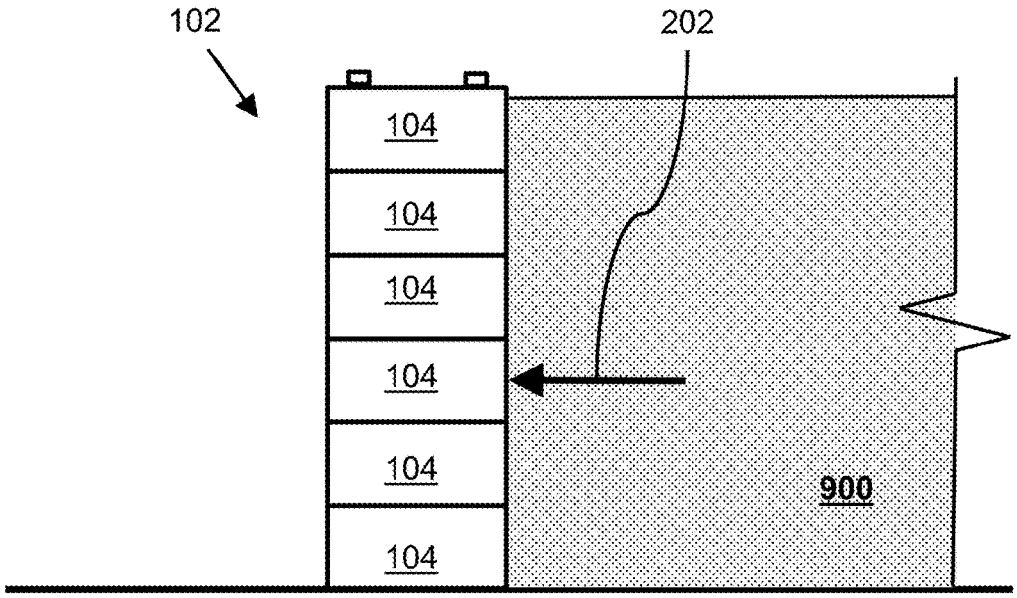

FIG. 8 depicts a side view taken along a cross-sectional line A-A of FIG. 7A.

Referring to the embodiments as depicted in FIGS. 4 to 7A and 7B, the apparatus 100 includes (and is not limited to) the monolithic retaining wall 102. The monolithic retaining wall 102 is formed by (or by a combination of at least some of) the combinable modular retaining wall blocks 104.

Each of (or at least some of) the blocks 104 defines, at least in part, (A) vertical grooves 106 extending along a vertical direction, and (B) the horizontal grooves 108 extending along a horizontal direction. This is done in such a way that the monolithic retaining wall 102, which is formed by (at least some of) the combinable modular retaining wall blocks 104, defines (A) spaced-apart instances of the vertical channels 206 extending vertically through the monolithic retaining wall 102, and (B) spaced-apart instances of the horizontal channels 208 extending horizontally through the monolithic retaining wall 102, in which at least some of the spaced-apart instances of the horizontal channels 208 intersect at least some of the spaced-apart instances of the vertical channels 206.

In accordance with a preferred embodiment, the spaced-apart instances of the vertical channels 206 include a combination of the vertical grooves 106 of a neighboring instance of the blocks 104 (placed or positioned in a side-by-side spatial relationship). The spaced-apart instances of the horizontal channels 208 include a combination of the horizontal grooves 108 of a neighboring instance of the blocks 104 (placed or positioned in a one-above-the-other spatial relationship).

The monolithic retaining wall 102 further includes a rebar cage structure 110 that is installed (at least in part) in (A) the spaced-apart instances of the vertical channels 206 defined by the monolithic retaining wall 102, and (B) the spaced-apart instances of the horizontal channels 208 defined by the monolithic retaining wall 102. This is done in such a way that the rebar cage structure 110 extends, at least in part, along at least some of (A) the spaced-apart instances of the vertical channels 206 defined by the monolithic retaining wall 102, and (B) the spaced-apart instances of the horizontal channels 208 defined by the monolithic retaining wall 102.

Figure 6:
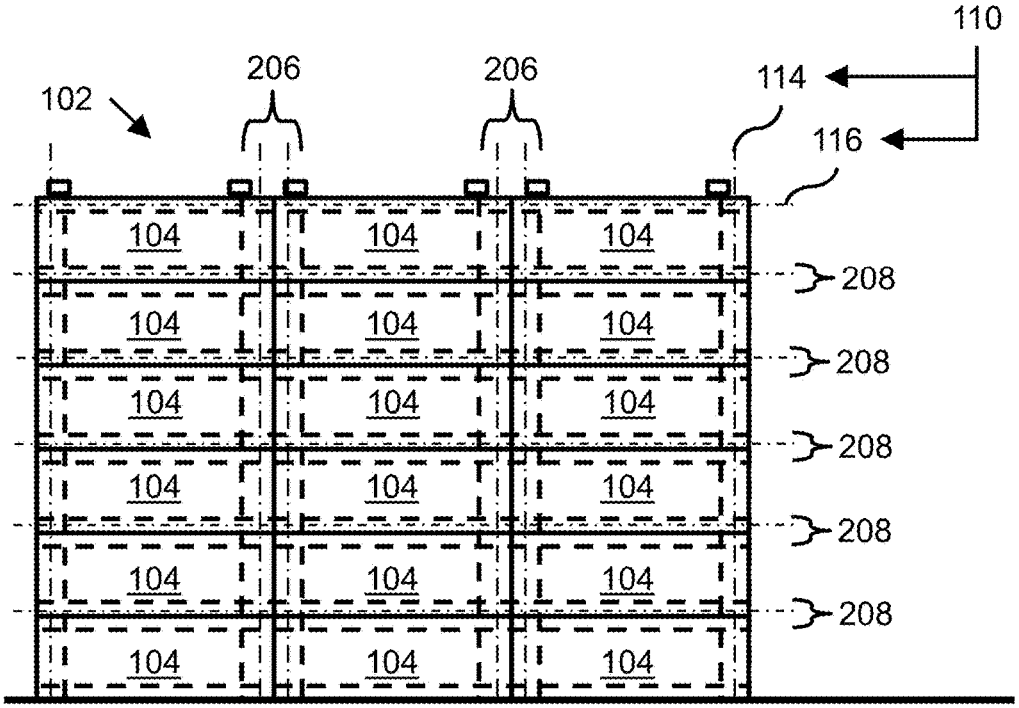

In accordance with a preferred embodiment as depicted in FIG. 6, the rebar cage structure 110 includes: (A) vertical rebars 114 extending along a vertical direction, and (B) the horizontal rebars 116 extending along a horizontal direction. The vertical rebars 114 extend along the vertical direction through (at least some of) the respective instances of the spaced-apart instances of the vertical channels 206. The horizontal rebars 116 extend along the horizontal direction through (at least some of) the respective instances of the spaced-apart instances of the horizontal channels 208.

The monolithic retaining wall 102 further includes hardened concrete 112 bonded with at least some of the rebar cage structure 110 that is positioned in (A) the spaced-apart instances of the vertical channels 206 defined by the monolithic retaining wall 102, and (B) the spaced-apart instances of the horizontal channels 208 defined by the monolithic retaining wall 102.

The concrete slurry is made to flow into (at least in part): (A) the spaced-apart instances of the vertical channels 206 defined by the monolithic retaining wall 102, and (B) the spaced-apart instances of the horizontal channels 208 defined by the monolithic retaining wall 102. This is done in such a way that concrete slurry (in use or application) flows around the rebar cage structure 110 that is installed (received) in (A) the instances of the spaced-apart instances of the vertical channels 206, and (B) the instances of the spaced-apart instances of the horizontal channels 208.

The hardened concrete 112 is bonded with at least some of the blocks 104 forming the monolithic retaining wall 102. The hardened concrete 112 was formed by: (A) pouring the concrete slurry into: (a) the spaced-apart instances of the vertical channels 206 defined by the monolithic retaining wall 102, and (b) the spaced-apart instances of the horizontal channels 208 defined by the monolithic retaining wall 102 in which the rebar cage structure 110 is installed therein; and (B) allowing the concrete slurry to harden in (a) the spaced-apart instances of the vertical channels 206 defined by the monolithic retaining wall 102, and (b) the spaced-apart instances of the horizontal channels 208 defined by the monolithic retaining wall 102 (in which the rebar cage structure 110 is installed therein).

The hardened concrete 112 (which is bonded with (A) the blocks 104 forming the monolithic retaining wall 102, and (B) the rebar cage structure 110 that is positioned in the spaced-apart instances of the vertical channels 206 of the monolithic retaining wall 102) in combination with the rebar cage structure 110 are configured to bear, in use, the application of a combination of (a) a compressive force 200 to the hardened concrete 112 as a result of the weight of the combinable modular retaining wall blocks 104 installed in the monolithic retaining wall 102, and (b) a vertical tension force 201 to the hardened concrete 112, in which the vertical tension force 201 is a result of the weight of soil bearing against the monolithic retaining wall 102. The vertical tension force 201 is applicable along the vertical direction extending vertically through the blocks 104 that form the monolithic retaining wall 102.

The hardened concrete 112, which is bonded with (A) the blocks 104 forming the monolithic retaining wall 102, and (B) the rebar cage structure 110 that is positioned in the spaced-apart instances of the horizontal channels 208 of the monolithic retaining wall 102, in combination with the rebar cage structure 110 are configured to bear, in use, a horizontal tension force 202, in which the horizontal tension force 202 is a result of the weight of the soil 900 bearing against the monolithic retaining wall 102 along the horizontal direction extending horizontally through the blocks 104 that form the monolithic retaining wall 102.

Referring to the embodiment as depicted in FIG. 7B, at least some of the blocks 104 define a vertical passageway 140 (without being combined with another instance of the block 104). The vertical passageway 140 extends (at least in part) through the body of the block 104. The wall 102 includes a combination of the instances of the block 104 that define the vertical passageway 140. It will be appreciated that the blocks 104 may be laid (to form the wall 102 as depicted in FIG. 7B) so that the blocks 104 are staggered and have one block 104 sitting on top of two instances of the block 104 (set up side-by-side). A spirit level may be used to make sure the blocks 104 are laid horizontally flat (repeated until the wall 102 has reached the desired height). The wall 102 as depicted in FIG. 7B is a preferred arrangement for stronger and more secured construction of the wall 102.

Referring to the embodiments as depicted in FIGS. 4 to 7A and 7B, a method of constructing a monolithic retaining wall 102 is described. The method includes (and is not limited to) a synergistic combination of an operation (A), an operation (B), an operation (C) and an operation (D).

The operation (A) includes (and is not limited to) spatially positioning the combinable modular retaining wall blocks 104 (also called the blocks 104). This is done in such a way that the blocks 104 form the monolithic retaining wall 102 relative to a working surface. More specifically, each of the blocks 104 defines: (A) vertical grooves 106 extending along a vertical direction, and (B) the horizontal grooves 108 extending along a horizontal direction. This is done in such a way that the monolithic retaining wall 102, which is formed by the combinable modular retaining wall blocks 104, defines (A) spaced-apart instances of the vertical channels 206 extending vertically through the monolithic retaining wall 102, and (B) spaced-apart instances of the horizontal channels 208 extending horizontally through the monolithic retaining wall 102, in which at least some of the spaced-apart instances of the horizontal channels 208 intersect at least some of the spaced-apart instances of the vertical channels 206 extending vertically through the monolithic retaining wall 102.

The operation (B) includes (and is not limited to) installing a rebar cage structure 110 in (A) the spaced-apart instances of the vertical channels 206 defined by the monolithic retaining wall 102, and (B) the spaced-apart instances of the horizontal channels 208 defined by the monolithic retaining wall 102. This is done in such a way that the rebar cage structure 110 extends, at least in part, along at least some of (A) the spaced-apart instances of the vertical channels 206 defined by the monolithic retaining wall 102, and (B) the spaced-apart instances of the horizontal channels 208 defined by the monolithic retaining wall 102.

The operation (C) includes (and is not limited to) forming the monolithic retaining wall 102 by pouring the concrete slurry into (A) the spaced-apart instances of the vertical channels 206 defined by the monolithic retaining wall 102, and (B) the spaced-apart instances of the horizontal channels 208 defined by the monolithic retaining wall 102 in which the rebar cage structure 110 is installed, at least in part, therein.

The operation (D) includes (and is not limited to) waiting for the concrete slurry to harden into hardened concrete 112. This is done in such a way that the hardened concrete 112 becomes bonded with at least some of (A) the blocks 104 forming the monolithic retaining wall 102, and (B) the rebar cage structure 110 that is positioned in (i) the spaced-apart instances of the vertical channels 206 defined by the monolithic retaining wall 102, and (ii) the spaced-apart instances of the horizontal channels 208 defined by the monolithic retaining wall 102.

In addition, operation (D) is also done in such a way that the hardened concrete 112, which becomes bonded with at least some of (A) the blocks 104 forming the monolithic retaining wall 102, and (B) the rebar cage structure 110 that is positioned in the spaced-apart instances of the vertical channels 206 of the monolithic retaining wall 102, in combination with the rebar cage structure 110 are configured to bear, in use, the application of a combination of (a) a compressive force 200 to the hardened concrete 112 as a result of the weight of the combinable modular retaining wall blocks 104 installed in the monolithic retaining wall 102, and (b) a vertical tension force 201 as a result of the weight of soil bearing against the monolithic retaining wall 102, in which the vertical tension force 201 is applicable along the vertical direction extending vertically through the blocks 104 that form the monolithic retaining wall 102.

In addition, operation (D) is also done in such a way that the hardened concrete 112, which becomes bonded with at least some of (A) the blocks 104 forming the monolithic retaining wall 102, and (B) the rebar cage structure 110 that is positioned in the spaced-apart instances of the horizontal channels 208 of the monolithic retaining wall 102, in combination with the rebar cage structure 110 are configured to bear, in use, a horizontal tension force 202 as a result of the weight of soil bearing against the monolithic retaining wall 102 along the horizontal direction extending horizontally through the blocks 104 that form the monolithic retaining wall 102.

Figure 9:
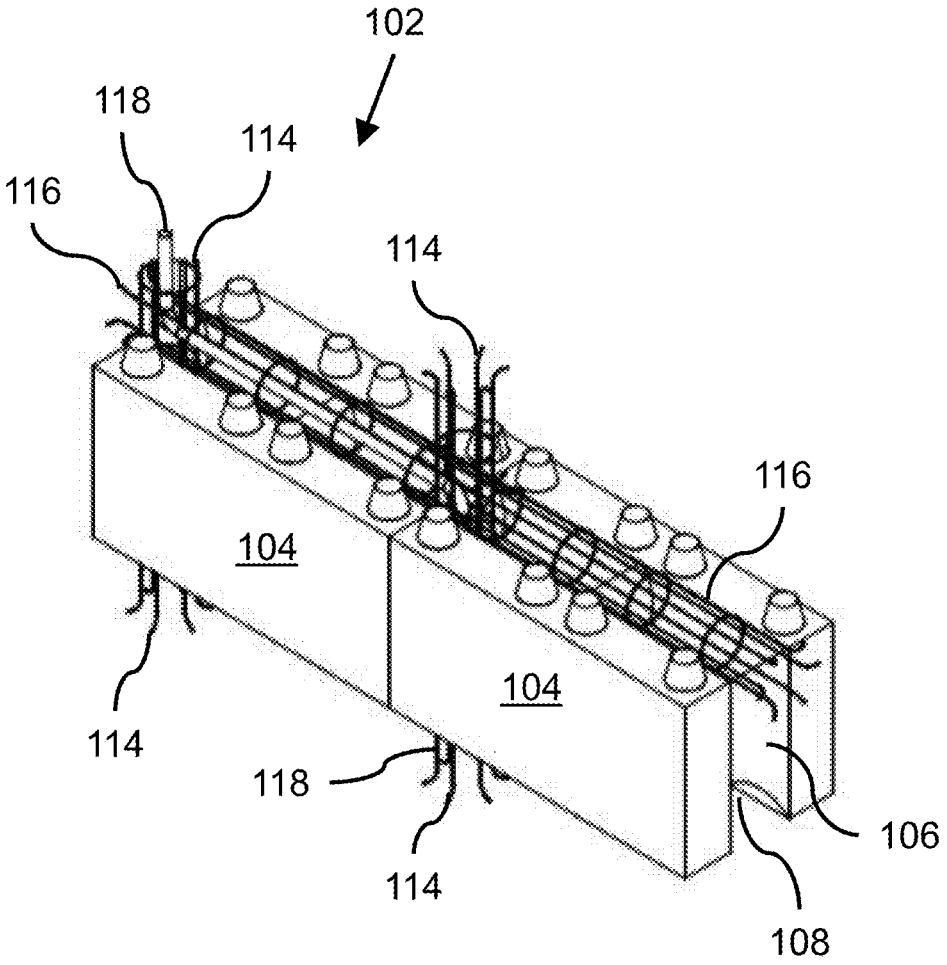
FIG. 9 depicts a perspective view of a portion of an embodiment of the monolithic retaining wall of FIG. 6.

FIG. 9 depicts a perspective view of a portion of an embodiment of the monolithic retaining wall 102 of FIG. 6.

In accordance with the embodiments as depicted in FIG. 9, the blocks 104 include a standard full block version (two instances of the block 104 are placed in an end-to-end relationship). At least one of the vertical rebars 114 (also called a vertical rebar cage) is: (A) received, at least in part, in at least one of the vertical grooves 106, and/or (B) aligned, at least in part, along at least one of the vertical grooves 106. At least one of the horizontal rebars 116 (also called a horizontal rebar cage) is: (A) received, at least in part, in at least one of the horizontal grooves 108, and/or (B) aligned, at least in part, along at least one of the horizontal grooves 108. Preferably, the block 104 includes hardened concrete or a combination of hardened concrete and rebar extending within the block 104.

In accordance with the embodiments as depicted in FIG. 9, a utility pipe 118 (also called a utility pipe run) is positioned inside at least one of the vertical grooves 106 and/or at least one of the horizontal grooves 108 (defined by at least two or more instances of the blocks 104), and/or any passageway that extends (at least in part) through the block 104. The utility pipe 118 is aligned along at least one of the vertical rebars 114 and/or the horizontal rebars 116. The utility pipe 118 is configured to receive a utility line (communications line, telephone line, electrical power lines, etc., and any equivalent thereof). The direction of the utility pipe 118 may change from vertical to horizontal and back to vertical, etc.

Figure 10:
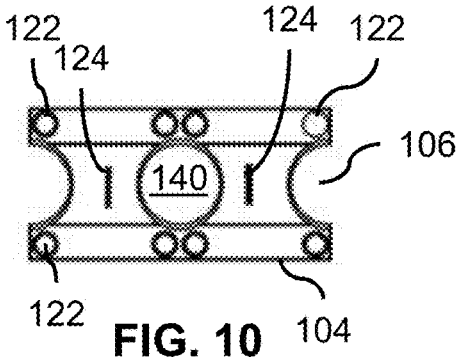
FIGS. 10 to 13 depict views of embodiments of the combinable modular retaining wall block of FIG. 1.
Figure 11:
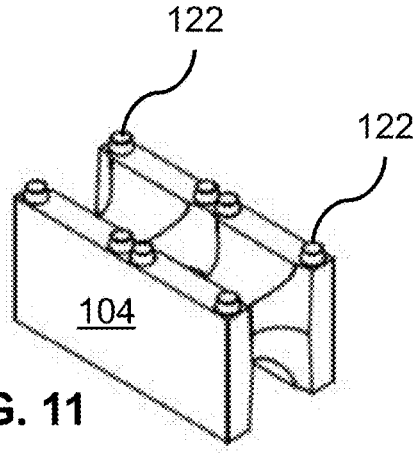
Figure 12:
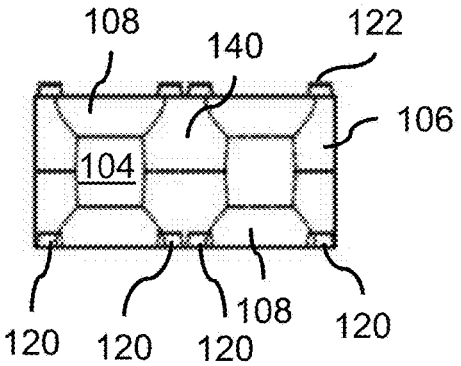
Figure 13:
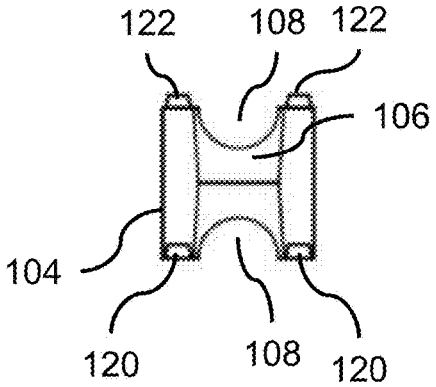

FIGS. 10 to 13 depict views of embodiments of the combinable modular retaining wall block 104 of FIG. 1. FIG. 10 depicts a top view. FIG. 11 depicts a perspective view from the top. FIG. 12 depicts a lateral side view. FIG. 13 depicts an end view.

In accordance with the embodiments as depicted in FIGS. 10 to 13, the block 104 includes steel reinforcing embedded in a hardened concrete body (if so desired). The block 104 defines a vertical passageway 140 (without being combined with another instance of the block 104) that extends (at least in part) through the body of the block 104. Preferably, the block 104 includes a reinforced concrete block including a first interlocking feature 120 (positioned on the bottom side of the block 104) and a second interlocking feature 122 (positioned on the top side of the block 104).

It will be appreciated that some embodiments of the block 104 may include the vertical passageway 140 while other embodiments of the block 104 do not include the vertical passageway 140. It will be appreciated that, in accordance with some embodiments, the wall 102 may include instances of the block 104 in which the instances of the block 104 do not define the vertical passageway 140.

The first interlocking feature 120 of an instance of the block 104 is configured to interlock (interface or mate) with the second interlocking feature 122 of a neighboring instance of the block 104 that is stacked vertically relative to the instance of the block 104. In this manner, the blocks 104 may be stacked one over the other in a secured manner during the construction of the wall 102, as depicted in FIG. 7A or FIG. 7B.

It will be appreciated that the blocks 104 may be laid so that the blocks 104 are staggered and have one block 104 sitting on top of two instances of the block 104. A spirit level may be used to make sure the blocks 104 are laid horizontally flat (repeated until the wall 102 has reached the desired height). This relationship is depicted in FIG. 7B (this is the preferred arrangement for stronger and more secured construction of the wall 102).

Alternatively, it will be appreciated that the blocks 104 may be laid so that the blocks 104 are not staggered and one instance of the block 104 sits on top (or is stacked over) of only one other instance of the block 104 (in which case, the first interlocking feature 120 and the second interlocking feature 122 may be relied upon for vertical stability (while rebars are positioned in the blocks 104 as the blocks are vertically stacked, one layer of blocks over the other layer of blocks). It will be appreciated that the wall 102 may be constructed with a combination of (A) the staggered arrangement as described in the previous paragraph and (B) the stacked arrangement as described in this paragraph.

Preferably, the first interlocking feature 120 includes a shaped void (also called a conical void or a pyramidal void), which may be oblong shaped. The second interlocking feature 122 includes a shaped projection (also called a conical projection or a pyramidal projection).

A lifting loop 124 (also called a lifting eye) is affixed to a top section of the block 104. The lifting loop 124 is configured to facilitate lifting of the block 104 by a machine.

Preferably, the horizontal grooves 108 include a tapered semicircular void. The vertical channels 206 includes a tapered cylindrical void. The block 104 includes at least one (or more) instances of the vertical groove 106 shaped to provide tapered voids. The block 104 includes at least one (or more) instances of the horizontal groove 108 shaped to provide tapered voids. The technical effect of this arrangement is that the block 104 is more easily removed from a casting form and/or produces a relatively stronger mechanical connection yielding a relatively higher-strength instance of the monolithic retaining wall 102 (as depicted in FIG. 7A or FIG. 7B). For instance, this embodiment may be more desirable in areas of high seismic activity.

Figure 14:
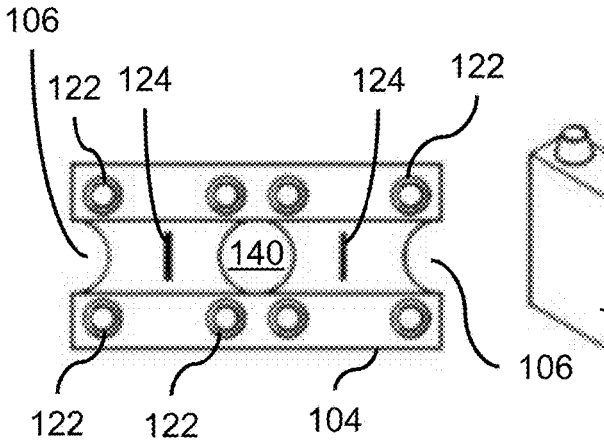
FIGS. 14 to 17 depict views of embodiments of the combinable modular retaining wall block of FIG. 1.
Figure 15:
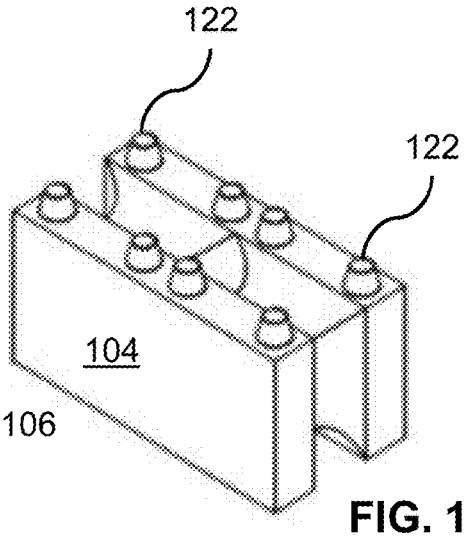
Figure 16:
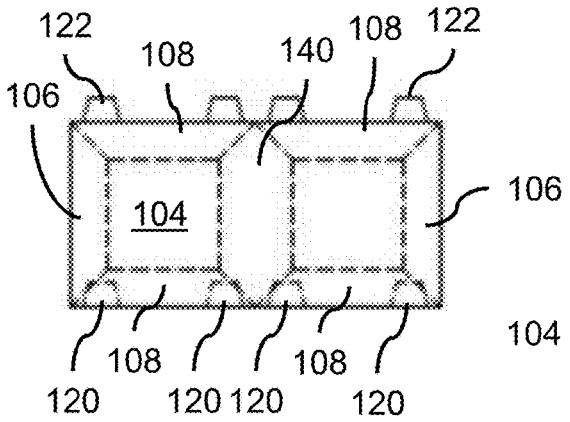
Figure 17:
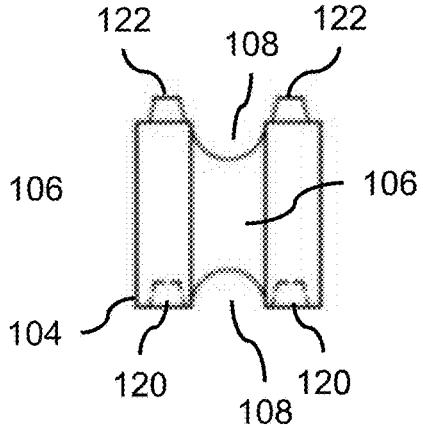

FIGS. 14 to 17 depict views of embodiments of the combinable modular retaining wall block 104 of FIG. 1. FIG. 14 depicts a top view. FIG. 15 depicts a perspective view from the top. FIG. 16 depicts a lateral side view. FIG. 17 depicts an end view.

In accordance with the embodiments as depicted in FIGS. 14 to 17, the block 104 includes (forms) a top side, a bottom side and opposite lateral sides, and the block 104 is configured to form parallel voids along the top side, the bottom side and the opposite lateral sides. The block 104 defines a vertical passageway 140 (without being combined with another instance of the block 104).

Figure 18:
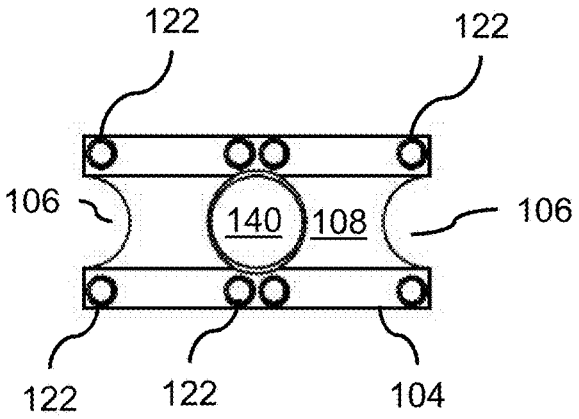
FIGS. 18 to 21 depict views of embodiments of the combinable modular retaining wall block of FIG. 1.
Figure 19:
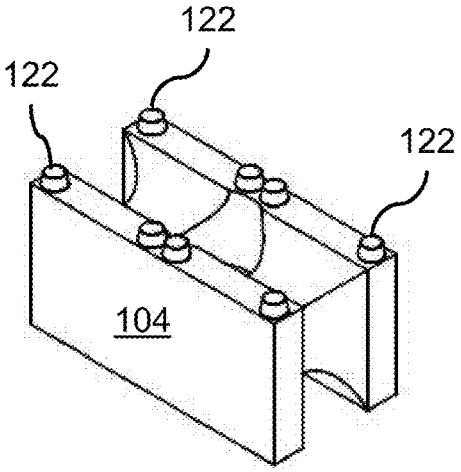
Figure 20:
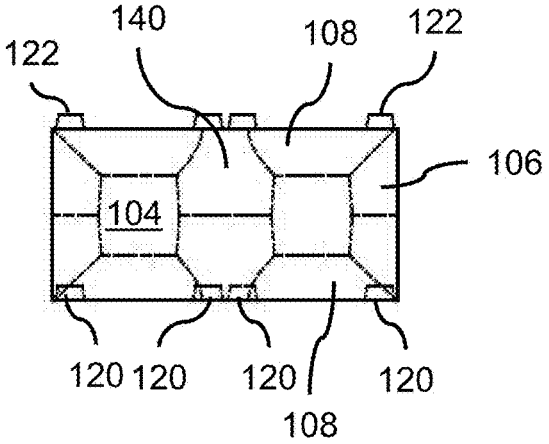
Figure 21:
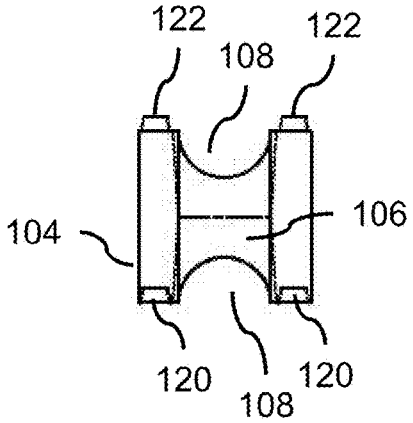

FIGS. 18 to 21 depict views of embodiments of the combinable modular retaining wall block 104 of FIG. 1. FIG. 18 depicts a top view. FIG. 19 depicts a perspective view from the top. FIG. 20 depicts a lateral side view. FIG. 21 depicts an end view.

In accordance with the embodiments as depicted in FIGS. 18 to 21, the block 104 defines a vertical passageway 140 (without being combined with another instance of the block 104). Preferably, the block 104 is cast formed by using the tapered center void and parallel outer channels.

Figure 22:
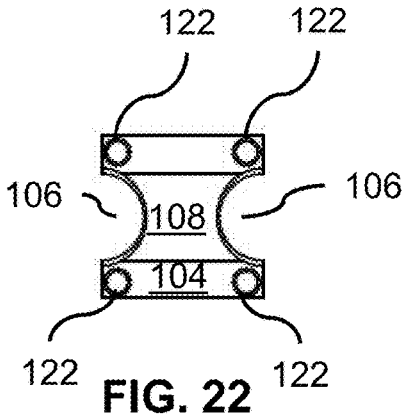
FIGS. 22 to 25 depict views of embodiments of the combinable modular retaining wall block of FIG. 1.
Figure 23:
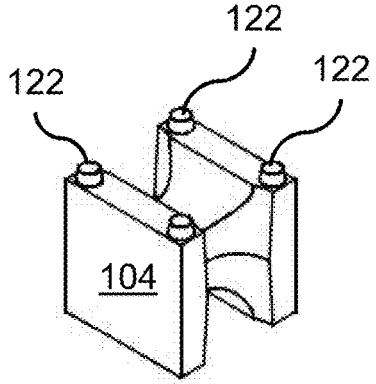
Figure 24:
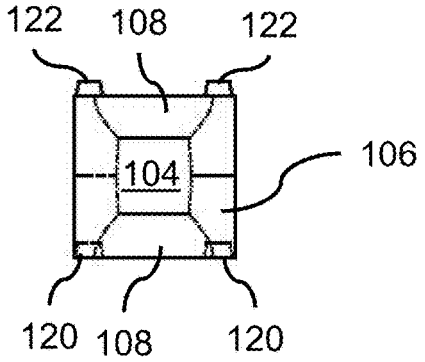
Figure 25:
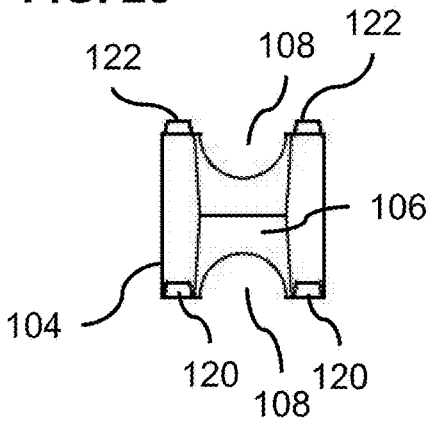

FIGS. 22 to 25 depict views of embodiments of the combinable modular retaining wall block 104 of FIG. 1. FIG. 22 depicts a top view. FIG. 23 depicts a perspective view from the top. FIG. 24 depicts a lateral side view. FIG. 25 depicts an end view.

In accordance with the embodiments as depicted in FIGS. 22 to 25, the block 104 is configured to allow a relatively smaller wall length adjustment and is offset to facilitate an overlap interlock of other instances of the block 104 (where needed). The block 104 is configured to allow relatively smaller wall length adjustment and is offset to facilitate an overlap interlock of the blocks 104 used in the construction of the wall 102, as depicted in FIG. 7A or FIG. 7B.

Figure 26:
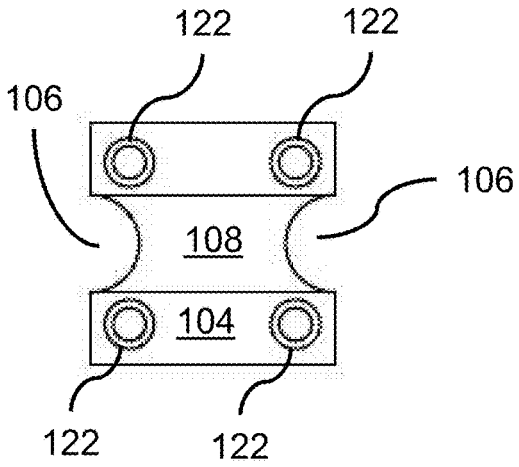
FIGS. 26 to 29 depict views of embodiments of the combinable modular retaining wall block of FIG. 1.
Figure 27:
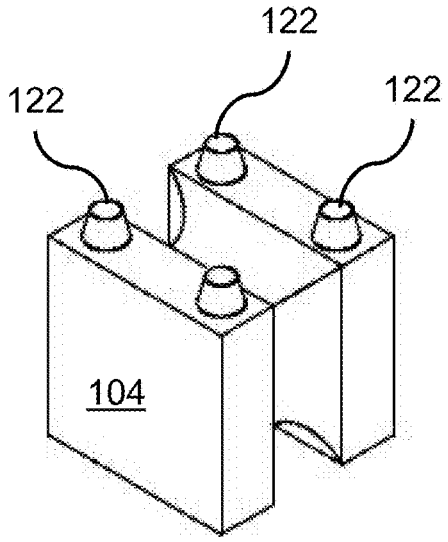
Figure 28:
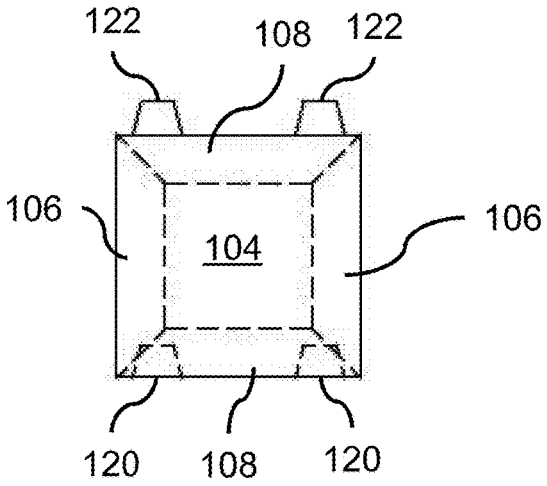
Figure 29:
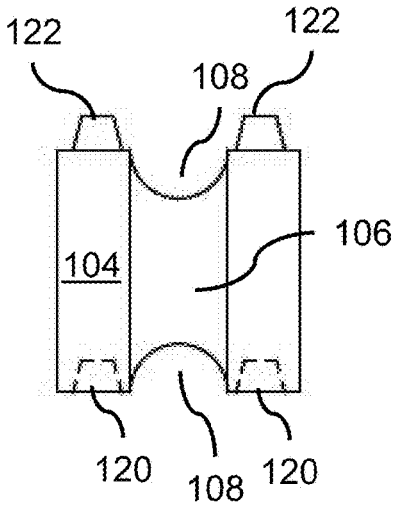

FIGS. 26 to 29 depict views of embodiments of the combinable modular retaining wall block 104 of FIG. 1. FIG. 26 depicts a top view. FIG. 27 depicts a perspective view from the top. FIG. 28 depicts a lateral side view. FIG. 29 depicts an end view.

In accordance with the embodiments as depicted in FIGS. 26 to 29, the block 104 is configured to allow wall length adjustments and to provide an offset to facilitate an overlap interlock of other instances of the block 104 (where needed). The block 104 is configured to allow wall length adjustments and offsets to facilitate an overlap interlock of the blocks 104 used in the construction of the wall 102, as depicted in FIG. 7A or FIG. 7B.

Figure 30:
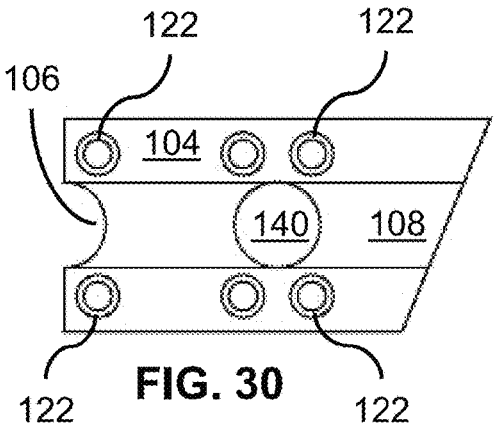
FIGS. 30 to 33 depict views of embodiments of the combinable modular retaining wall block of FIG. 1.
Figure 31:
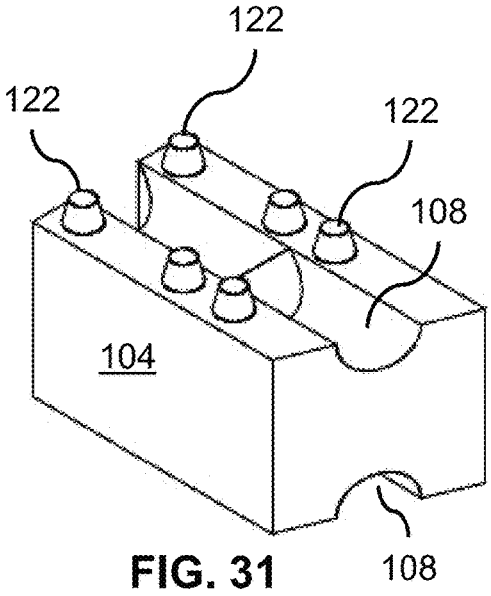
Figure 32:
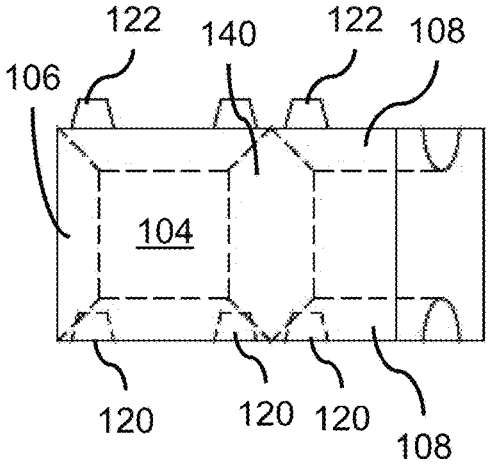
Figure 33:
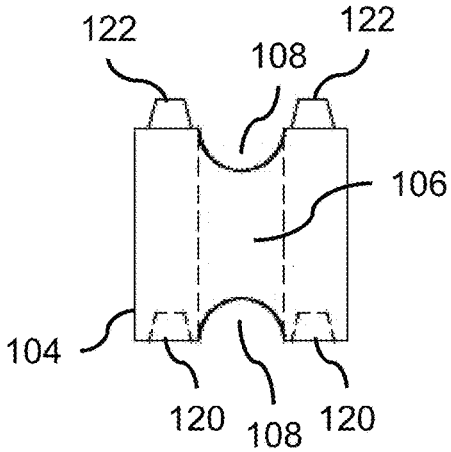

FIGS. 30 to 33 depict views of embodiments of the combinable modular retaining wall block 104 of FIG. 1. FIG. 30 depicts a top view. FIG. 31 depicts a perspective view from the top. FIG. 32 depicts a lateral side view. FIG. 33 depicts an end view.

Figure 34:
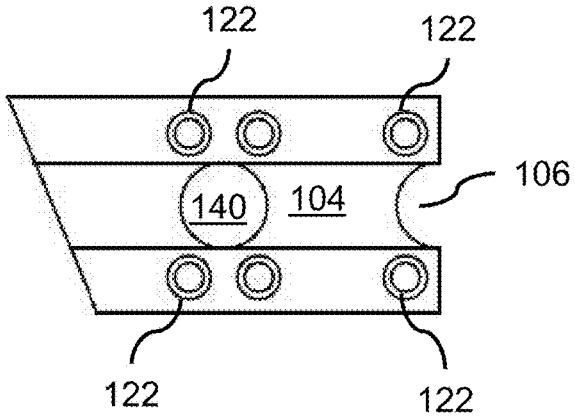
FIGS. 34 to 37 depict views of embodiments of the combinable modular retaining wall block of FIG. 1.

In accordance with the embodiments as depicted in FIGS. 30 to 33, the block 104 includes an angled face (such as, a 22.5 degree right-hand angle face). The block 104 defines a vertical passageway 140 (without being combined with another instance of the block 104). The block 104 (as depicted in FIG. 30) may be combined with the block 104 (as depicted in FIG. 34) to produce a section of the monolithic retaining wall 102 that has an angled corner (such as, a 45-degree corner). The combination of the block 104 (as depicted in FIG. 30) and the block 104 (as depicted in FIG. 34) and the block 104 (as depicted in FIG. 38) may be used in alternating courses to produce an interlocked corner.

Figure 35:
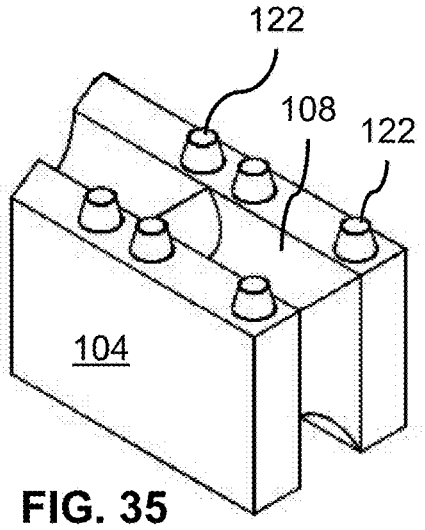
Figure 36:
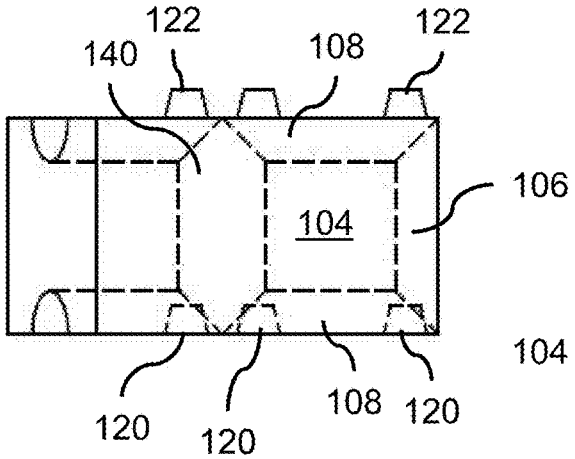
Figure 37:
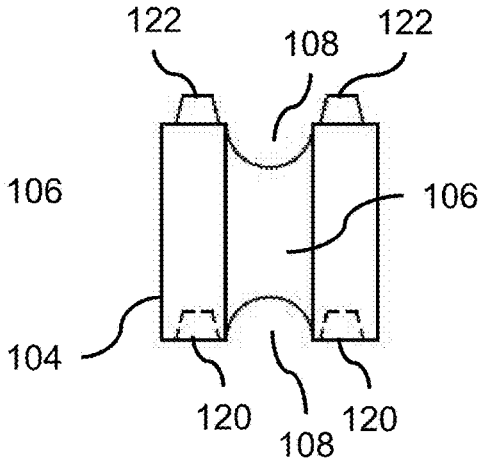

FIGS. 34 to 37 depict views of embodiments of the combinable modular retaining wall block 104 of FIG. 1. FIG. 34 depicts a top view. FIG. 35 depicts a perspective view from the top. FIG. 36 depicts a lateral side view. FIG. 37 depicts an end view.

In accordance with the embodiments as depicted in FIGS. 34 to 37, the block 104 defines a vertical passageway 140 (without being combined with another instance of the block 104). The block 104 (as depicted in FIG. 34) may be used with the block 104 (as depicted in FIG. 30) to produce a 45-degree corner (in the monolithic retaining wall 102, which is not depicted in FIG. 34). The combination of the block 104 (as depicted in FIG. 30) and the block 104 (as depicted in FIG. 34) and the block 104 (as depicted in FIG. 38) may be used in alternating courses to produce an interlocked corner.

Figure 38:
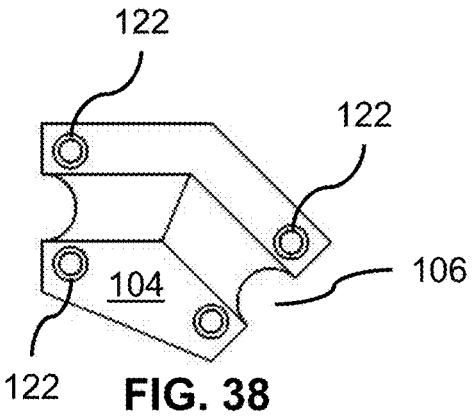
FIGS. 38 to 41 depict views of embodiments of the combinable modular retaining wall block of FIG. 1.
Figure 39:
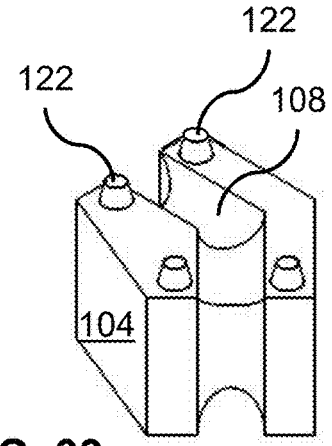
Figure 40:
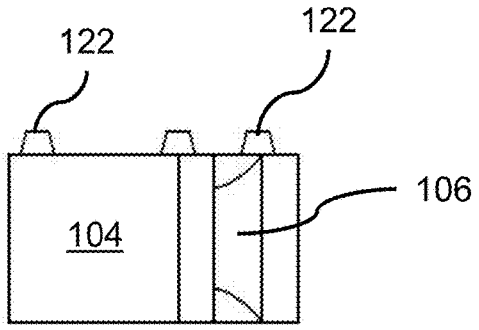
Figure 41:
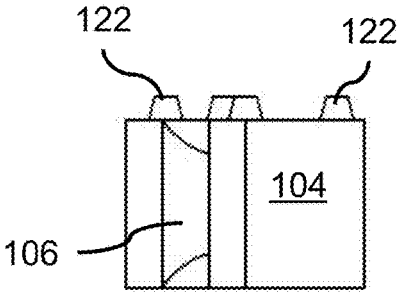

FIGS. 38 to 41 depict views of embodiments of the combinable modular retaining wall block 104 of FIG. 1. FIG. 38 depicts a top view. FIG. 39 depicts a perspective view from the top. FIG. 40 depicts a lateral side view. FIG. 41 depicts an end view.

In accordance with the embodiments as depicted in FIGS. 38 to 41, the block 104 (as depicted in FIG. 38) may be combined with the block 104 (as depicted in FIG. 30) and/or with the block 104 (as depicted in FIG. 34) to produce a 45-degree interlocked corner.

Figure 42:
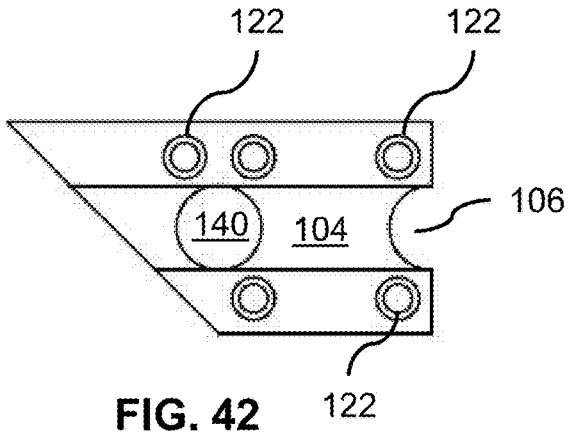
FIGS. 42 to 45 depict views of embodiments of the combinable modular retaining wall block of FIG. 1.
Figure 43:
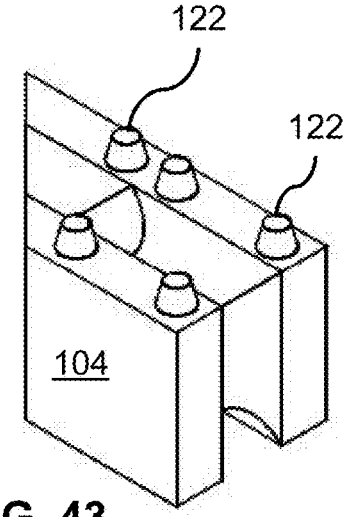
Figure 44:
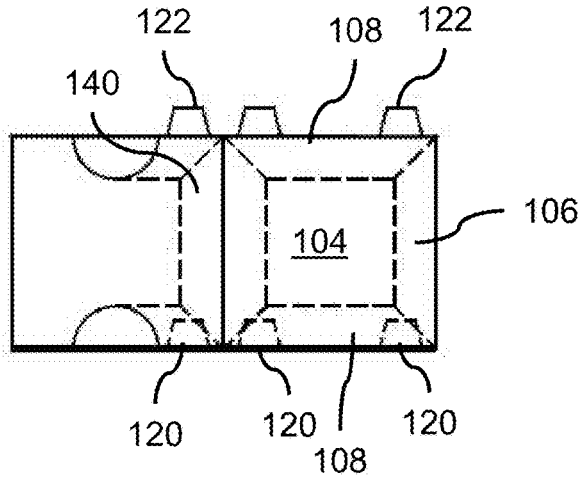
Figure 45:
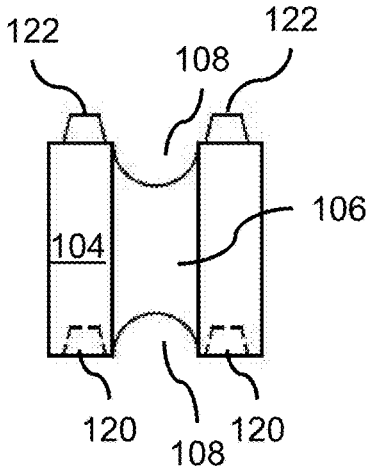

FIGS. 42 to 45 depict views of embodiments of the combinable modular retaining wall block 104 of FIG. 1. FIG. 42 depicts a top view. FIG. 43 depicts a perspective view from the top. FIG. 44 depicts a lateral side view. FIG. 45 depicts an end view.

Figure 46:
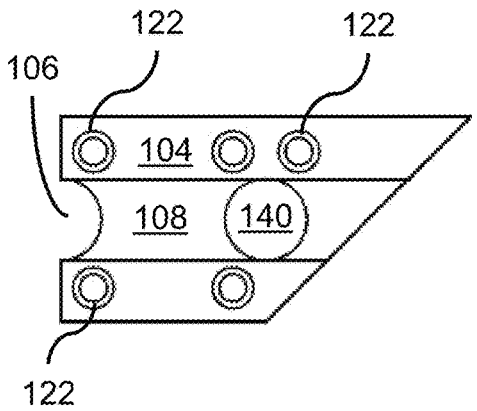
FIGS. 46 to 49 depict views of embodiments of the combinable modular retaining wall block of FIG. 1.

In accordance with the embodiments as depicted in FIGS. 42 to 45, the block 104 defines a vertical passageway 140 (without being combined with another instance of the block 104). The block 104 (as depicted in FIG. 42) is combinable with the block 104 (as depicted in FIG. 46) to make corners greater than 90 degrees by placing the points together and leaving a gap on the inside edge. The gap may be closed by normal concrete forming methods.

Figure 47:
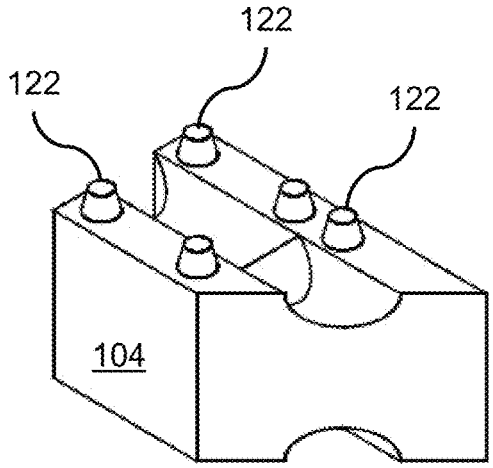
Figure 48:
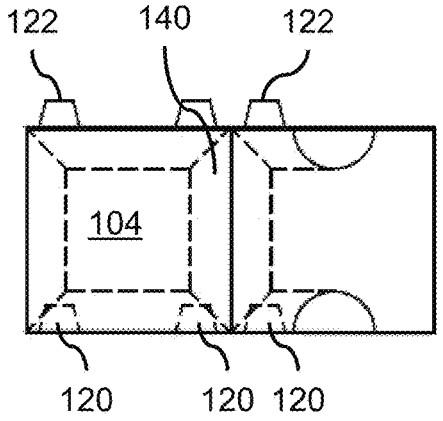
Figure 49:
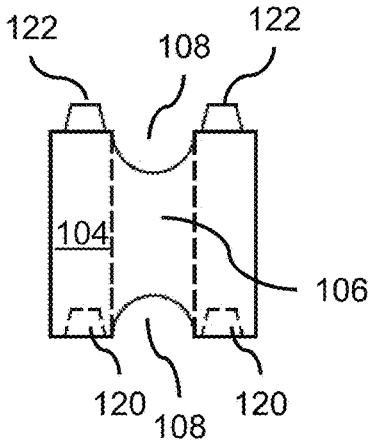

FIGS. 46 to 49 depict views of embodiments of the combinable modular retaining wall block 104 of FIG. 1. FIG. 46 depicts a top view. FIG. 47 depicts a perspective view from the top. FIG. 48 depicts a lateral side view. FIG. 49 depicts an end view.

In accordance with the embodiments as depicted in FIGS. 46 to 49, the block 104 defines a vertical passageway 140 (without being combined with another instance of the block 104). The block 104 (as depicted in FIG. 46) may be combined with the block 104 (as depicted in FIG. 42) to make corners greater than 90 degree by placing the points together and leaving a gap on the inside edge. The gap may be closed by normal concrete forming methods.

Figure 50:
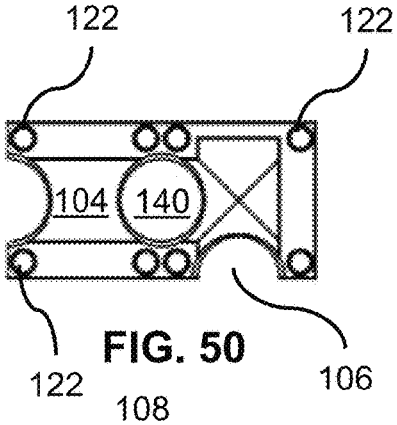
FIGS. 50 to 53 depict views of embodiments of the combinable modular retaining wall block of FIG. 1.
Figure 51:
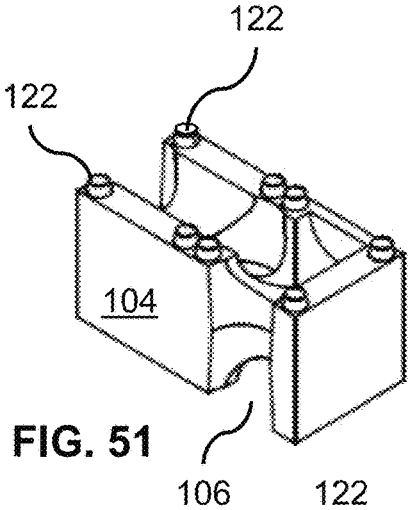
Figure 52:
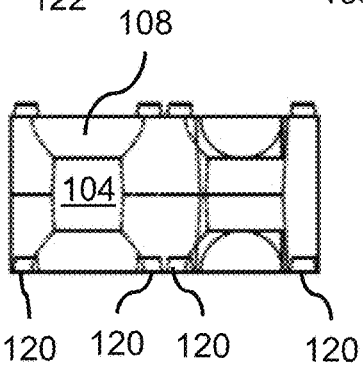
Figure 53:
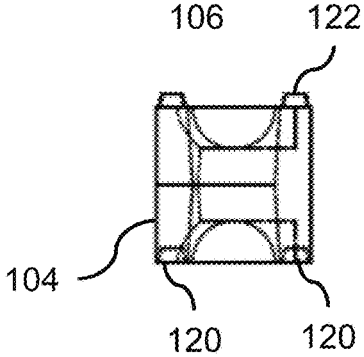

FIGS. 50 to 53 depict views of embodiments of the combinable modular retaining wall block 104 of FIG. 1. FIG. 50 depicts a top view. FIG. 51 depicts a perspective view from the top. FIG. 52 depicts a lateral side view. FIG. 53 depicts an end view.

Figure 90:
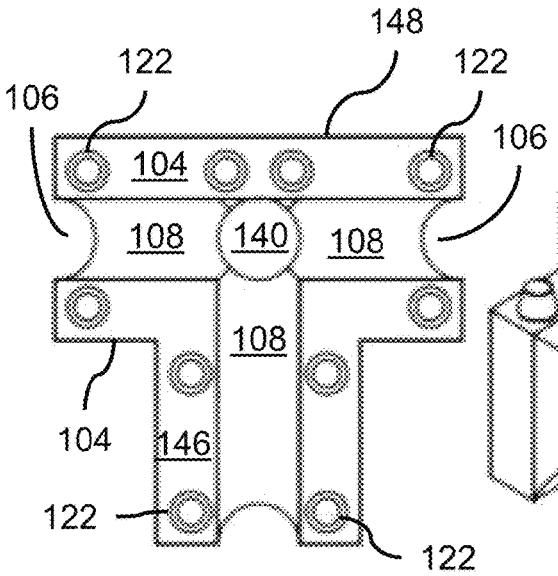
FIGS. 90 to 93 depict views of embodiments of the combinable modular retaining wall block of FIG. 1.
Figure 94:
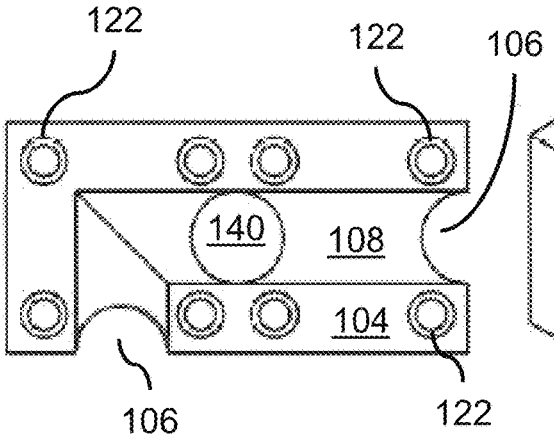
FIGS. 94 to 97 depict views of embodiments of the combinable modular retaining wall block of FIG. 1.
Figure 98:
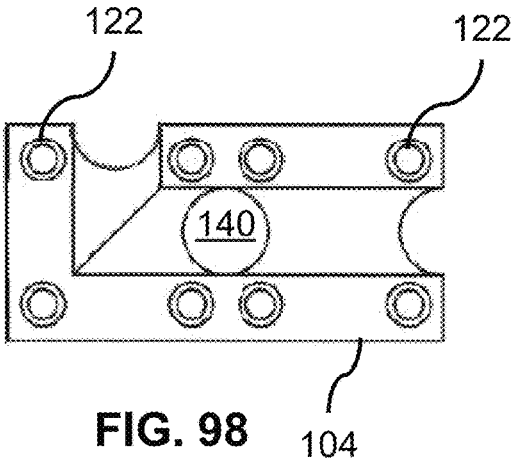
FIGS. 98 to 101 depict views of embodiments of the combinable modular retaining wall block of FIG. 1.

In accordance with the embodiments as depicted in FIGS. 50 to 53, the block 104 defines a vertical passageway 140 (without being combined with another instance of the block 104). The block 104 forming a semi-circular void 126 is rotated to the right. The block 104 is used with the block 104 (as depicted in FIG. 94) or the block 104 (as depicted in FIG. 98) or the block 104 (as depicted in FIG. 50), or the block 104 (as depicted in FIG. 90) on alternating courses to produce interlocked 90-degree corners and allowing other instances of the block 104 to overlap and interlock.

Figure 54:
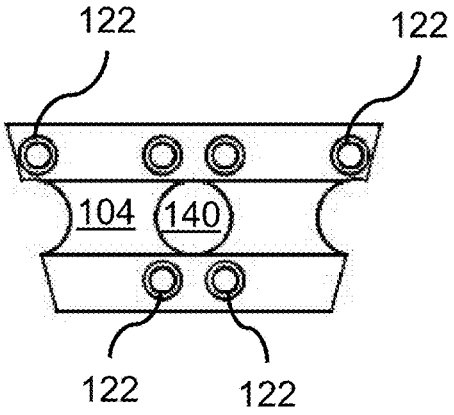
FIGS. 54 to 57 depict views of embodiments of the combinable modular retaining wall block of FIG. 1.
Figure 55:
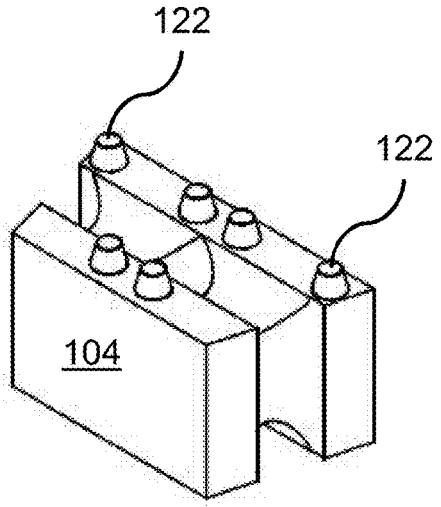
Figure 56:
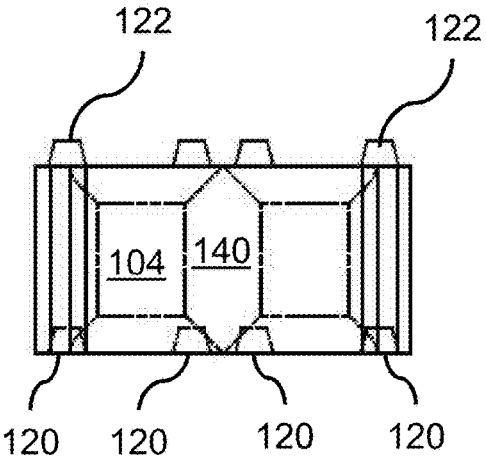
Figure 57:
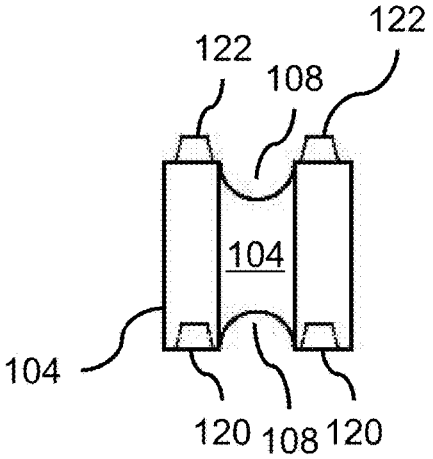
Figure 58:
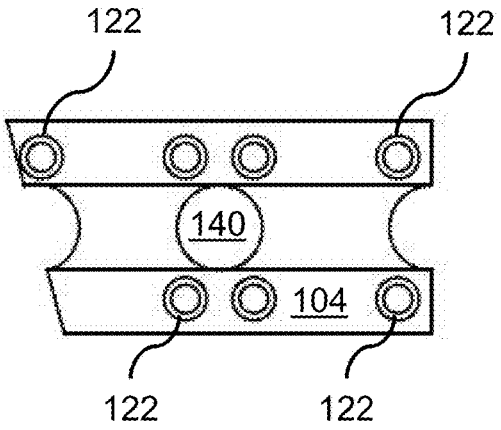
FIGS. 58 to 61 depict views of embodiments of the combinable modular retaining wall block of FIG. 1.

FIGS. 54 to 57 depict views of embodiments of the combinable modular retaining wall block 104 of FIG. 1. FIG. 54 depicts a top view. FIG. 55 depicts a perspective view from the top. FIG. 56 depicts a lateral side view. FIG. 58 depicts an end view.

In accordance with the embodiments as depicted in FIGS. 54 to 57, the block 104 defines a vertical passageway 140 (without being combined with another instance of the block 104). The block 104 includes a body with 15-degree faces positioned on opposite lateral sides of the body. The block 104 may be used in combination with the block 104 (as depicted in FIG. 58) and/or the block 104 (as depicted in FIG. 62) to produce a gradual 60-degree corner and/or with the block 104 as depicted in FIG. 58 and FIG. 54 and FIG. 62 to produce a gradual 90 degree corner.

Figure 59:
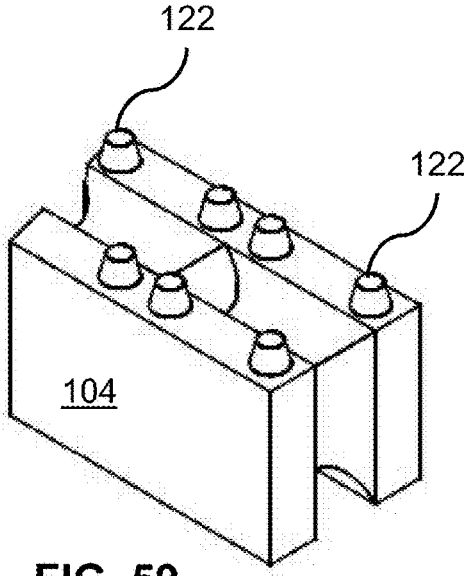
Figure 60:
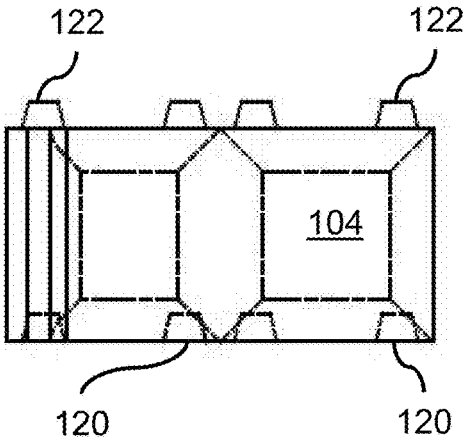
Figure 61:
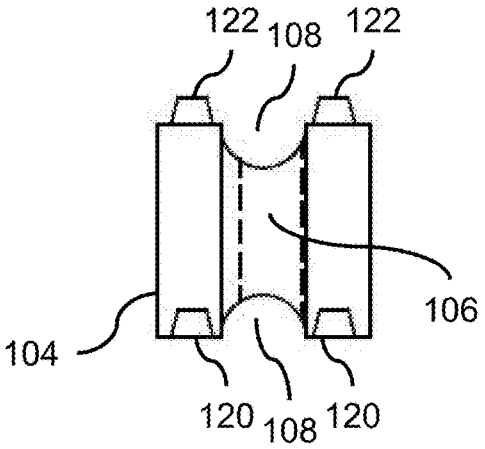

FIGS. 58 to 61 depict views of embodiments of the combinable modular retaining wall block 104 of FIG. 1. FIG. 58 depicts a top view. FIG. 59 depicts a perspective view from the top. FIG. 60 depicts a lateral side view. FIG. 61 depicts an end view.

In accordance with the embodiments as depicted in FIGS. 58 to 61, the block 104 defines a vertical passageway 140 (without being combined with another instance of the block 104). The block 104 includes a body defining (providing) a 15-degree angled face positioned to one of the lateral sides of the body. The block 104 (as depicted in FIG. 58) is combinable with the block 104 (as depicted in FIG. 62) to produce a 30-degree bend in the monolithic retaining wall 102. The block 104 (as depicted in FIG. 58) is combinable with the block 104 (as depicted in FIG. 54) and the block 104 (as depicted) in FIG. 62 to produce a gradual 60-degree bend, and/or with the blocks 104 as depicted in FIG. 58 and FIG. 54 and FIG. 62 to produce a gradual 90 degree corner.

Figure 62:
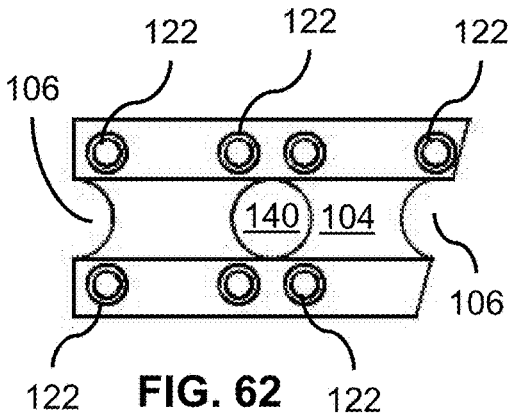
FIGS. 62 to 65 depict views of embodiments of the combinable modular retaining wall block of FIG. 1.
Figure 63:
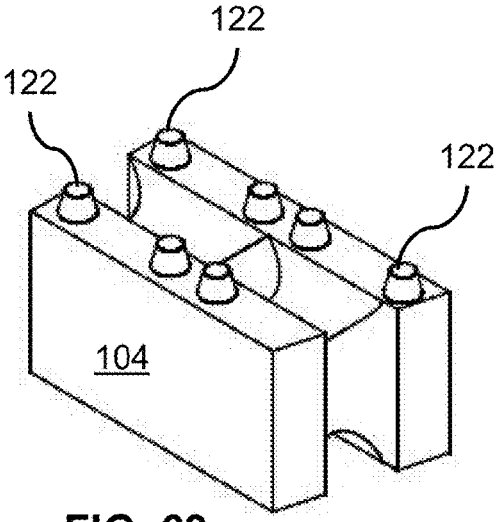
Figure 64:
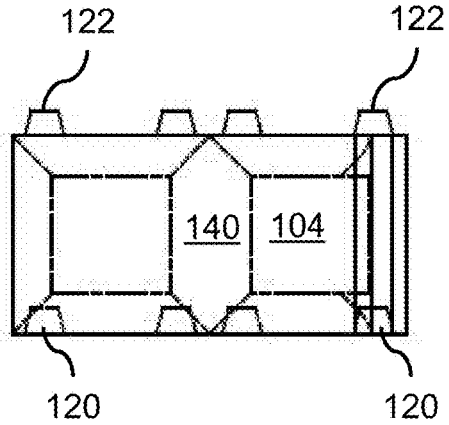
Figure 65:
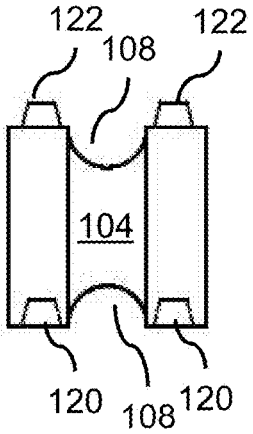

FIGS. 62 to 65 depict views of embodiments of the combinable modular retaining wall block 104 of FIG. 1. FIG. 62 depicts a top view. FIG. 63 depicts a perspective view from the top. FIG. 64 depicts a lateral side view. FIG. 65 depicts an end view.

In accordance with the embodiments as depicted in FIGS. 62 to 65, the block 104 defines a vertical passageway 140 (without being combined with another instance of the block 104). The block 104 includes an angled end-face portion (preferably angled at 15-degrees relative to the opposite lateral sides. The block 104 may be combined with the block 104 (as depicted in FIGS. 58 to 61) to produce a 30-degree bend in the alignment of the monolithic retaining wall 102 (as depicted in FIGS. 46 to 49). The block 104 may be combined with the block 104 (as depicted in FIGS. 54 to 57) and with the block 104 (as depicted in FIGS. 58 to 61) to produce a gradual 60-degree bend in the alignment of the monolithic retaining wall 102 (as depicted in FIG. 7A or FIG. 7B), and/or with the block 104 of FIG. 58 and FIG. 54 and FIG. 62 to produce a gradual 90 degree corner.

Figure 66:
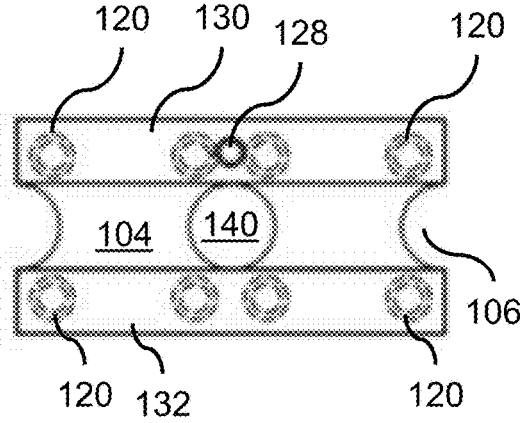
FIGS. 66 to 69 depict views of embodiments of the combinable modular retaining wall block of FIG. 1.
Figure 67:
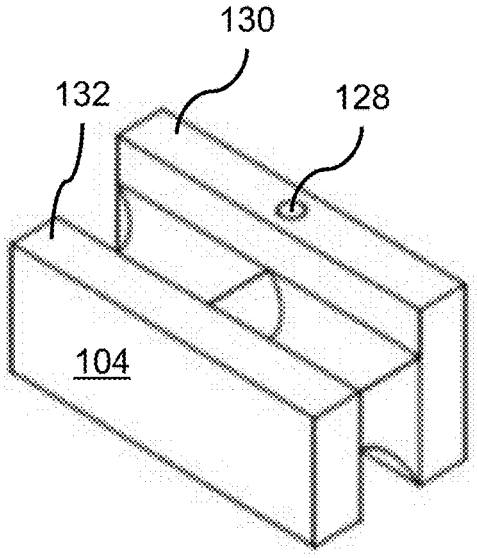
Figure 68:
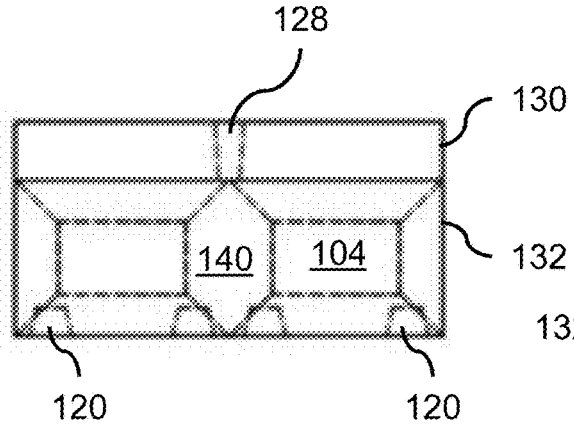
Figure 69:
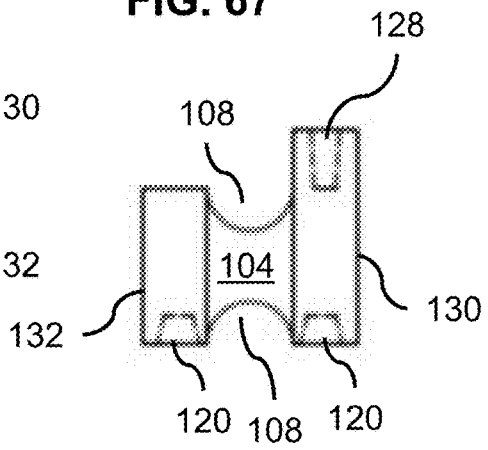

FIGS. 66 to 69 depict views of embodiments of the combinable modular retaining wall block 104 of FIG. 1. FIG. 66 depicts a top view. FIG. 67 depicts a perspective view from the top. FIG. 68 depicts a lateral side view. FIG. 69 depicts an end view.

In accordance with the embodiments as depicted in FIGS. 66 to 69, the block 104 includes a landscape block. The block 104 defines a vertical passageway 140 (without being combined with another instance of the block 104). The block 104 includes a fence post hole 128 formed in at least one of the opposite side faces. The block 104 includes a first lateral side face 130 and a second lateral side face 132. More preferably, the second lateral side face 132 has a height that is lower than the height of the first lateral side face 130. The second lateral side face 132 is configured to allow soil or roadway fill to the edge of the block 104.

Figure 70:
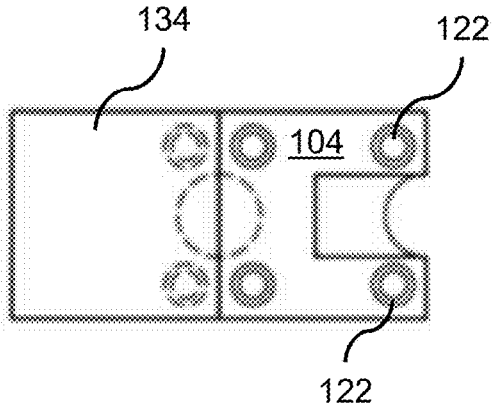
FIGS. 70 to 73 depict views of embodiments of the combinable modular retaining wall block of FIG. 1.
Figure 71:
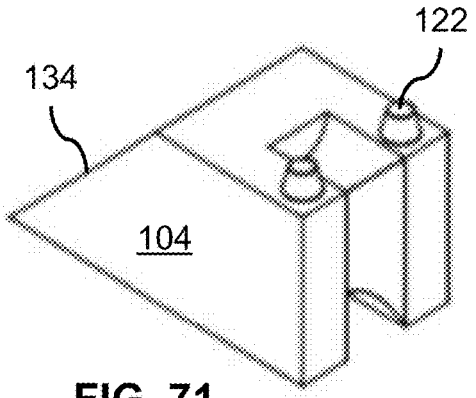
Figure 72:
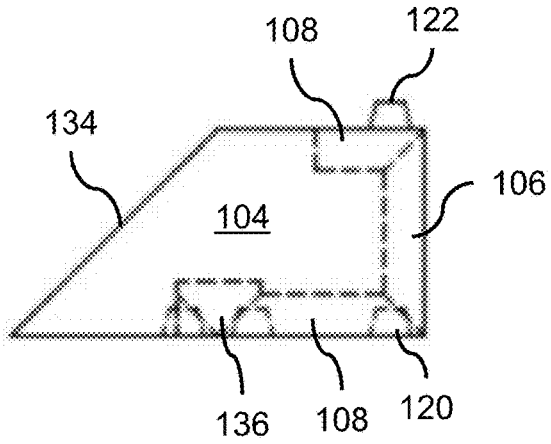
Figure 73:
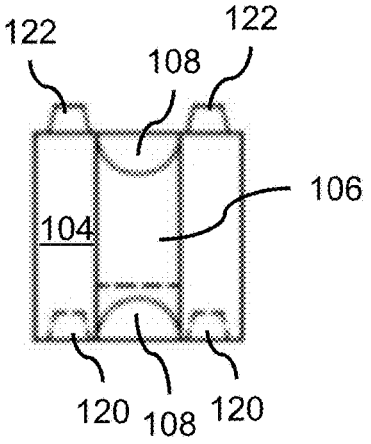

FIGS. 70 to 73 depict views of embodiments of the combinable modular retaining wall block 104 of FIG. 1. FIG. 70 depicts a top view. FIG. 71 depicts a perspective view from the top. FIG. 72 depicts a lateral side view. FIG. 73 depicts an end view.

In accordance with the embodiments as depicted in FIGS. 70 to 73, the block 104 includes a sloped end surface 134 that slopes from the top side of the block 104 toward the bottom side of the block 104. Preferably, the sloped end surface 134 provides a 45-degree end cap for the block 104. The block 104 defines a capped void 136 at a bottom side of the block 104 configured to receive and accommodate an end portion of a rebar tie (to retain strength of the block 104).

Figure 74:
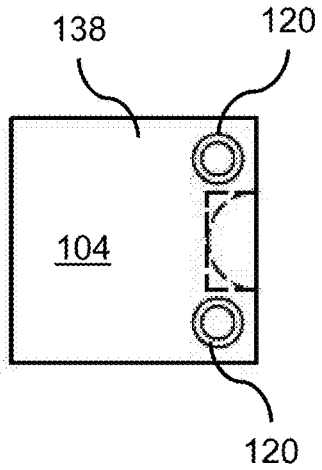
FIGS. 74 to 77 depict views of embodiments of the combinable modular retaining wall block of FIG. 1.
Figure 75:
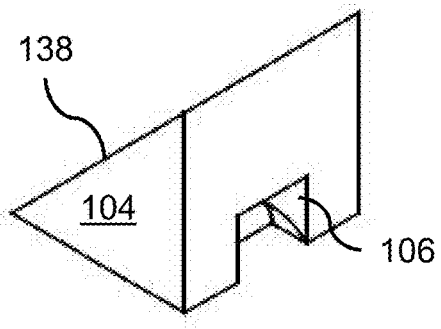
Figure 76:
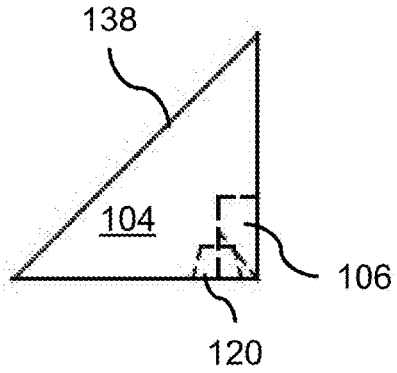
Figure 77:
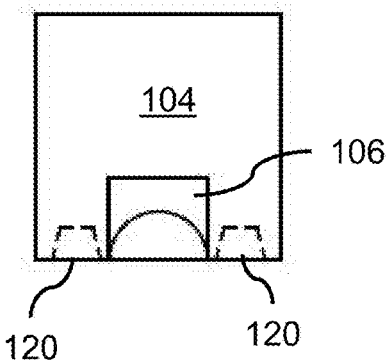

FIGS. 74 to 77 depict views of embodiments of the combinable modular retaining wall block 104 of FIG. 1. FIG. 74 depicts a top view. FIG. 75 depicts a perspective view from the top. FIG. 76 depicts a lateral side view. FIG. 77 depicts an end view.

In accordance with the embodiments as depicted in FIGS. 74 to 77, the block 104 forms a sloped half block. The block 104 defines a 45-degree end cap 138 for the case where the block 104 (as depicted in FIGS. 66 to 69) cannot be used.

Figure 78:
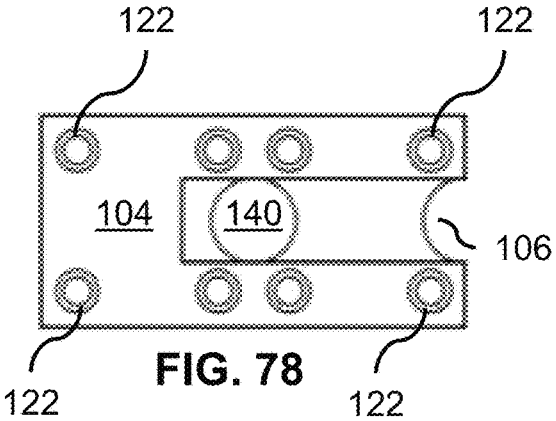
FIGS. 78 to 81 depict views of embodiments of the combinable modular retaining wall block of FIG. 1.
Figure 79:
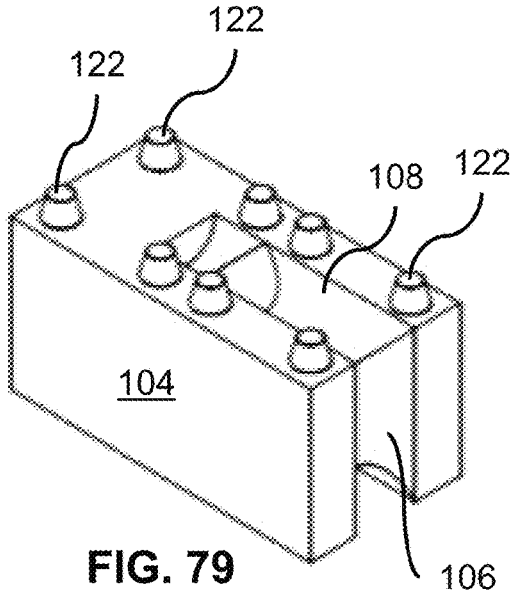
Figure 80:
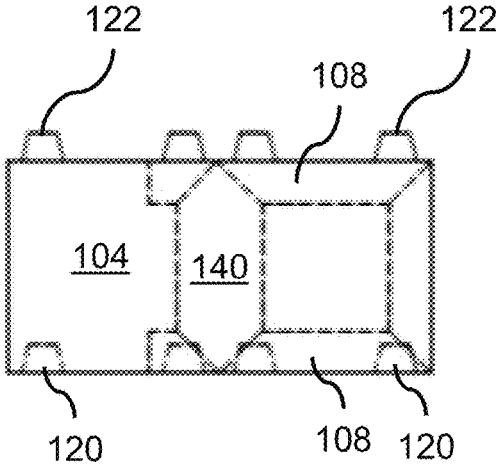
Figure 81:
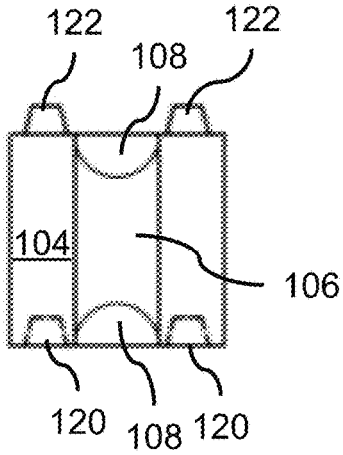

FIGS. 78 to 81 depict views of embodiments of the combinable modular retaining wall block 104 of FIG. 1. FIG. 78 depicts a top view. FIG. 79 depicts a perspective view from the top. FIG. 80 depicts a lateral side view. FIG. 81 depicts an end view.

In accordance with the embodiments as depicted in FIGS. 78 to 81, the block 104 includes a parallel void capped end block. The block 104 is configured to provide a finished wall end for the monolithic retaining wall 102 (as depicted in FIG. 7A or FIG. 7B). The block 104 defines a vertical passageway 140 (without being combined with another instance of the block 104). The vertical passageway 140 is configured to receive (at least in part) at least one of the vertical rebars 114 (as depicted in FIG. 7A or FIG. 7B) and the concrete slurry.

Figure 82:
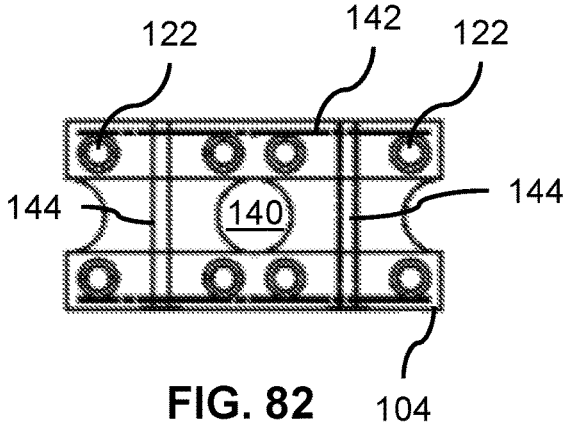
FIGS. 82 to 85 depict views of embodiments of the combinable modular retaining wall block of FIG. 1.
Figure 83:
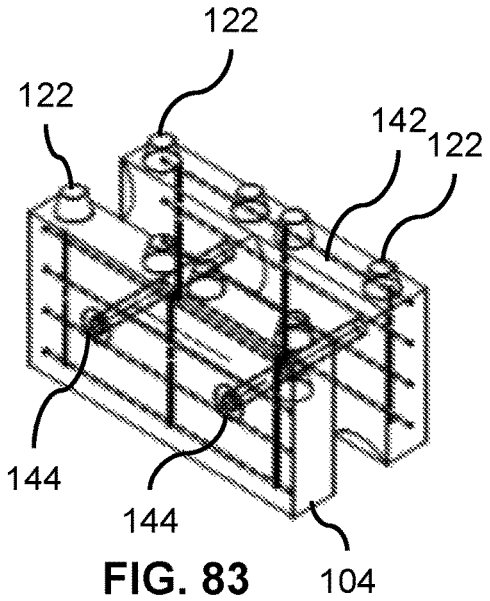
Figure 84:
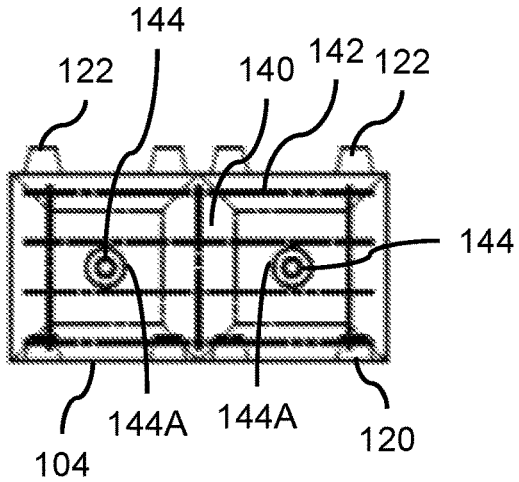
Figure 85:
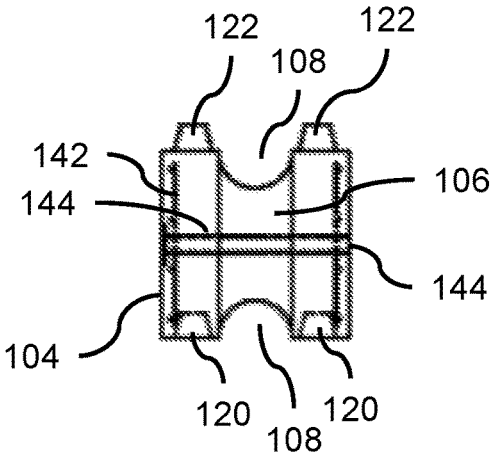

FIGS. 82 to 85 depict views of embodiments of the combinable modular retaining wall block 104 of FIG. 1. FIG. 82 depicts a top view. FIG. 83 depicts a perspective view from the top. FIG. 84 depicts a lateral side view. FIG. 85 depicts an end view.

In accordance with the embodiments as depicted in FIGS. 82 to 85, the block 104 includes a rock anchor block having a metal reinforcing cage 142 (indicated by the broken lines) formed therein. The metal reinforcing cage 142 is configured to anchor loading requirements. The block 104 defines a horizontally aligned anchor tube 144.

The anchor tube 144 may be aligned sloping upwardly, downwardly or angled to the right or to the left as may be required to properly align with the rock anchor. The anchor tube 144 includes an end plate 144A positioned on opposite sides of the anchor tube 144. The anchor tube 144 may be recessed into the outer face of the block 104 for aesthetic reasons thus hiding the end of a rock anchor (the rock anchor is known and not depicted and not described). The block 104 is configured to connect with the rock anchor.

Figure 86:
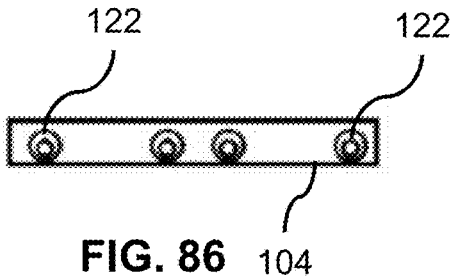
FIGS. 86 to 89 depict views of embodiments of the combinable modular retaining wall block of FIG. 1.
Figure 87:
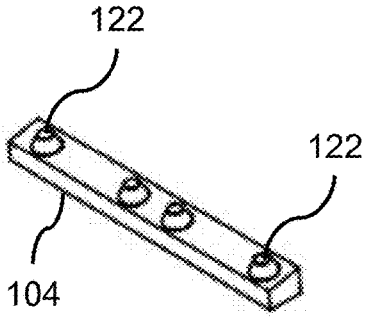
Figure 88:
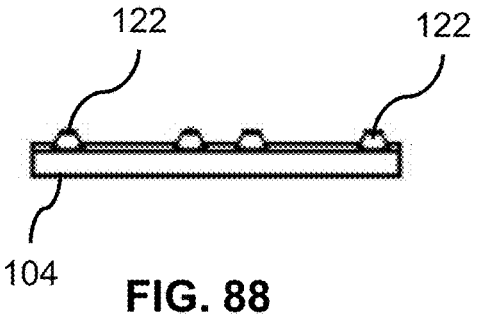
Figure 89:
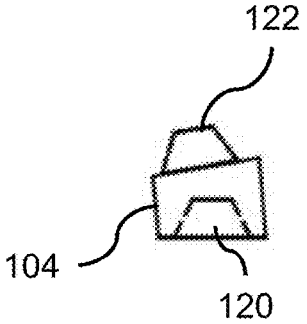

FIGS. 86 to 89 depict views of embodiments of the combinable modular retaining wall block 104 of FIG. 1. FIG. 86 depicts a top view. FIG. 87 depicts a perspective view from the top. FIG. 88 depicts a lateral side view. FIG. 89 depicts an end view.

In accordance with the embodiments as depicted in FIGS. 86 to 89, the block 104 includes an edge block (preferably defining a 10-degree angle along the edge). The block 104 is configured to sloped back at a 10-degree angle in such a way that the monolithic retaining wall 102 (as depicted in FIG. 8) is angled to one side and into the soil 900, and the weight of the monolithic retaining wall 102 is directed toward the soil, to stabilize (at least in part) the monolithic retaining wall 102. The block 104 is configured to sloped back at a 10-degree angle in such a way that the monolithic retaining wall 102 (as depicted in FIG. 8) is angled to one side and into the soil 900, and the block 104 is configured to turn a sloped instance of the monolithic retaining wall 102 back to the horizontal direction to allow installation of more horizontal wall or installation of landscape blocks or traffic barriers, etc.

Figure 91:
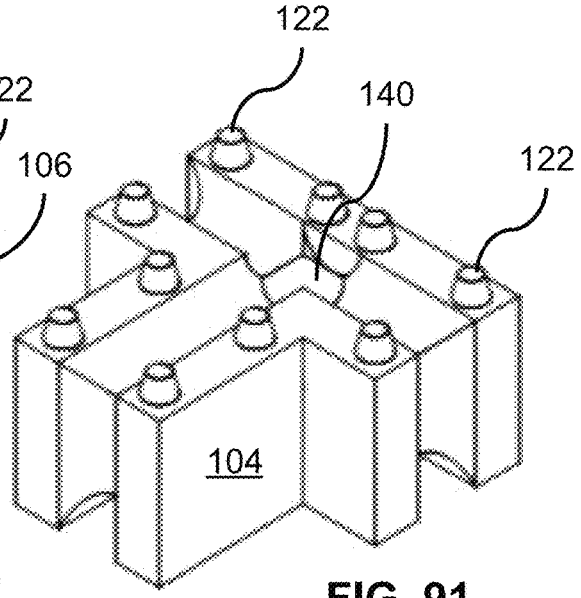
Figure 92:
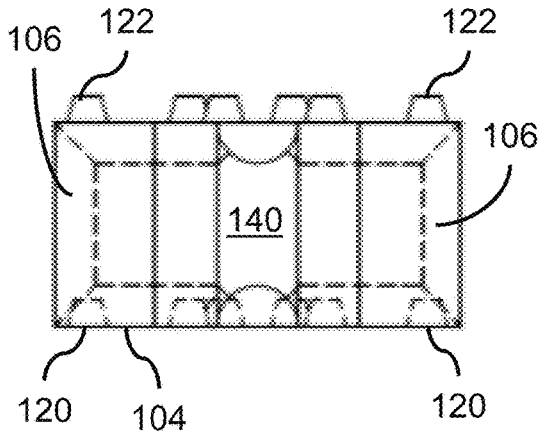
Figure 93:
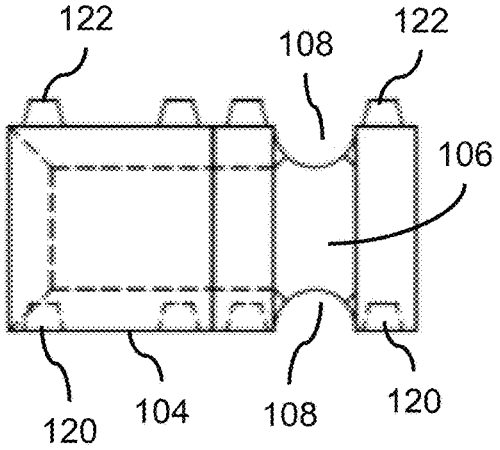

FIGS. 90 to 93 depict views of embodiments of the combinable modular retaining wall block 104 of FIG. 1. FIG. 90 depicts a top view. FIG. 91 depicts a perspective view from the top. FIG. 92 depicts a lateral side view. FIG. 93 depicts an end view.

In accordance with the embodiments as depicted in FIGS. 90 to 93, the block 104 defines a vertical passageway 140 (without being combined with another instance of the block 104). The block 104 includes a take-off T-shaped block. The block 104 includes a take-off section 146 that extends at a right angle from an outer face wall 148 of the block 104. The block 104 is configured to allow a 90-degree junction with another instance of the block 104 without interruption of the block sequence or appearance the monolithic retaining wall 102 (as depicted in FIGS. 46 to 49 or FIGS. 50 to 53). The block 104 forms a stiffening member configured to add rigidity to instances of the monolithic retaining wall 102 that are relatively vertically higher. With the combination of additional instances of the various types of the block 104, the block 104 becomes (at least in part) an anchor structure that is buried in the fill to anchor the monolithic retaining wall 102, thereby preventing tipping or lateral movement of the monolithic retaining wall 102.

Figure 95:
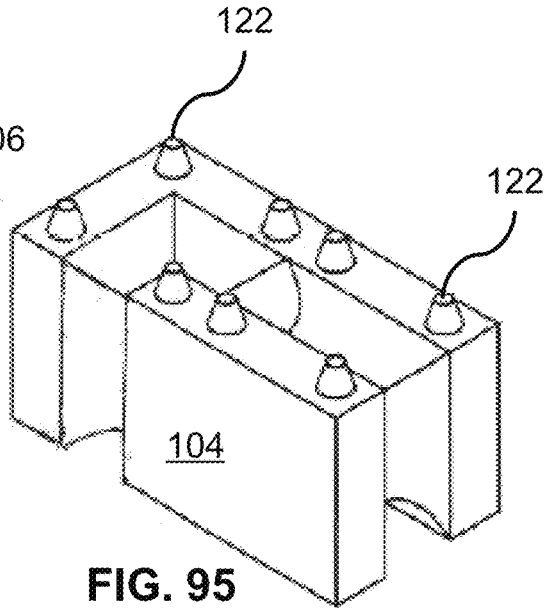
Figure 96:
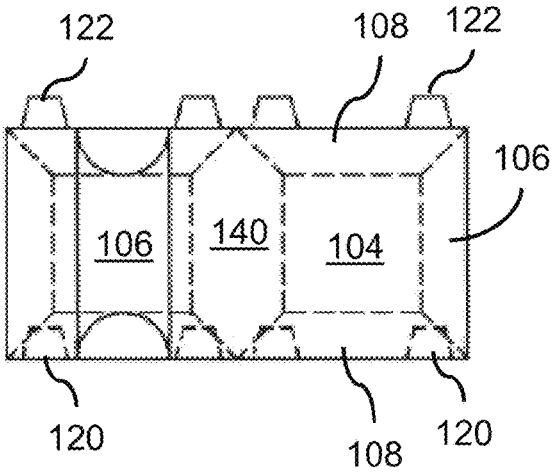
Figure 97:
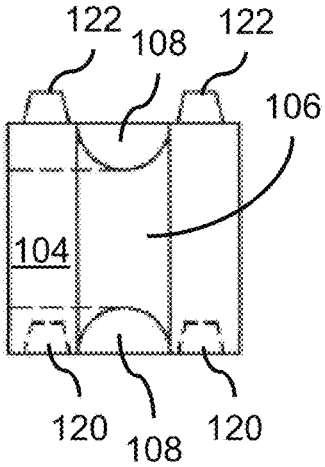

FIGS. 94 to 97 depict views of embodiments of the combinable modular retaining wall block 104 of FIG. 1. FIG. 94 depicts a top view. FIG. 95 depicts a perspective view from the top. FIG. 96 depicts a lateral side view. FIG. 97 depicts an end view.

In accordance with the embodiments as depicted in FIGS. 94 to 97, the block 104 includes a 90-degree turn block (left-hand turn block). The block 104 may be used in alternating courses with the block 104 (as depicted in FIGS. 90 to 93) to produce an interlocked 90-degree corner in the monolithic retaining wall 102 (as depicted in FIGS. 46 to 49).

Figure 99:
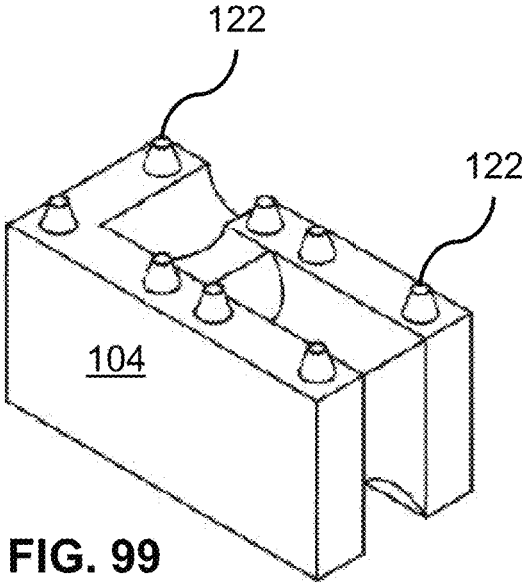
Figure 100:
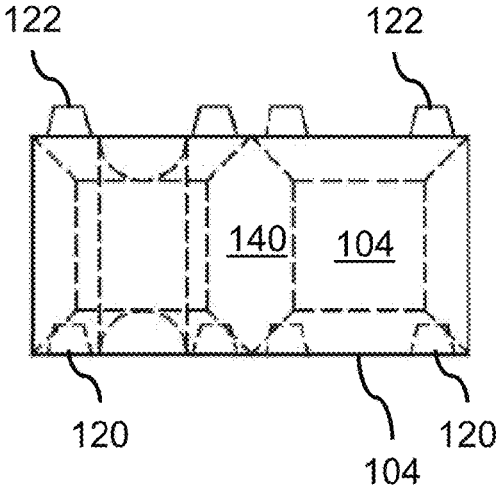
Figure 101:
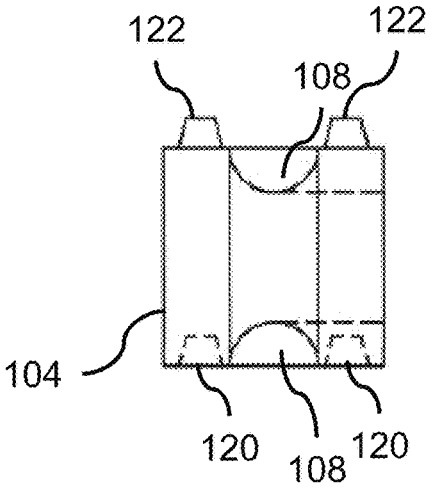

FIGS. 98 to 101 depict views of embodiments of the combinable modular retaining wall block 104 of FIG. 1. FIG. 98 depicts a top view. FIG. 99 depicts a perspective view from the top. FIG. 100 depicts a lateral side view. FIG. 101 depicts an end view.

In accordance with the embodiments as depicted in FIGS. 98 to 101, the block 104 includes a right-angle block having a 90-degree right-hand turn. The block 104 may be used in alternating course with the block 104 (as depicted in FIGS. 94 to 97) to produce an interlocked 90-degree corner in the monolithic retaining wall 102 (as depicted in FIGS. 46 to 49).

Figure 102:
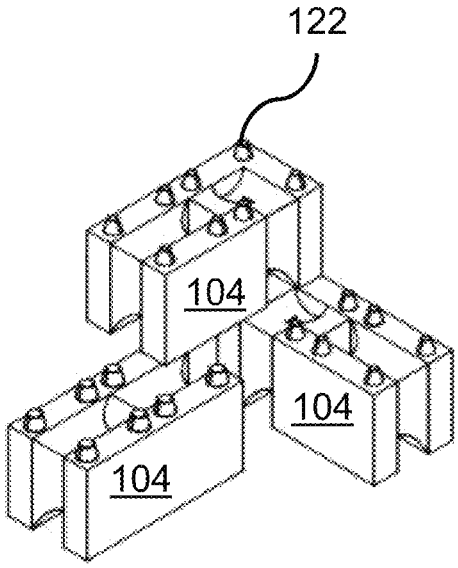
FIGS. 102 to 103 depict views of embodiments of the combinable modular retaining wall block of FIG. 1.
Figure 103:
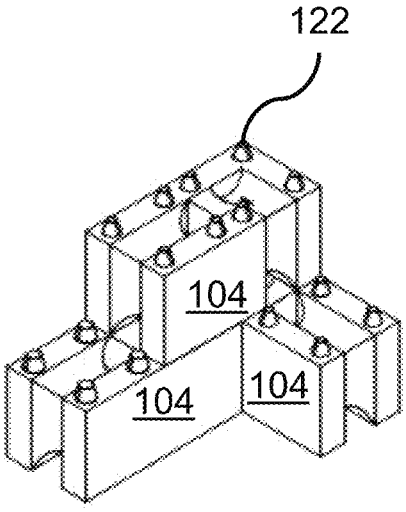

FIGS. 102 and 103 depict views of embodiments of the combinable modular retaining wall block 104 of FIG. 1. FIGS. 102 and 103 depict perspective views.

In accordance with the embodiments as depicted in FIGS. 102 and 103, the block 104 includes a corner-shaped block forming a right angle (such as, the blocks 104 as depicted in FIGS. 94 to 101).

Figure 104:
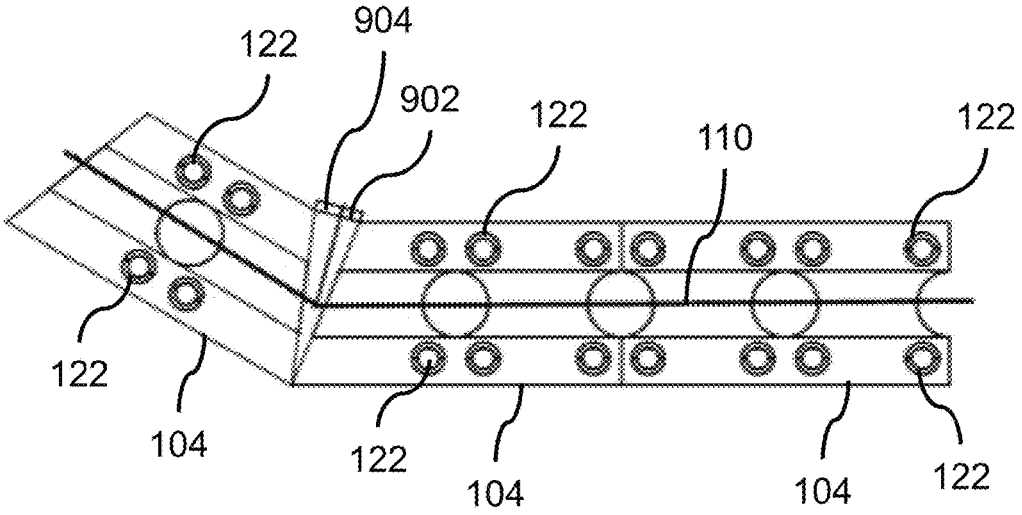
FIG. 104 depicts a view of an embodiment of the combinable modular retaining wall block of FIG. 1.

FIG. 104 depicts a view of an embodiment of the combinable modular retaining wall block 104 of FIG. 1. FIG. 104 depicts a top view.

In accordance with the embodiment as depicted in FIG. 104, instances of the block 104 are combined to form convex random angles. A form 902 is used (installed) to retain concrete. The form 902 may be attached by connector 904 (such as a bolt, other devices known to someone knowledgeable in the field of concrete forming, etc., and any equivalent thereof) to the rebar cage structure 110 that is positioned and aligned along at least some of the blocks 104. It will be appreciated that a wide range of angles may be achieved by adjusting the back side gap. Additional rebar may be installed vertically in the area defined by the gap to further increase the strength of the monolithic retaining wall 102. The front exposed face may remain consistent and continuous.

Figure 105:
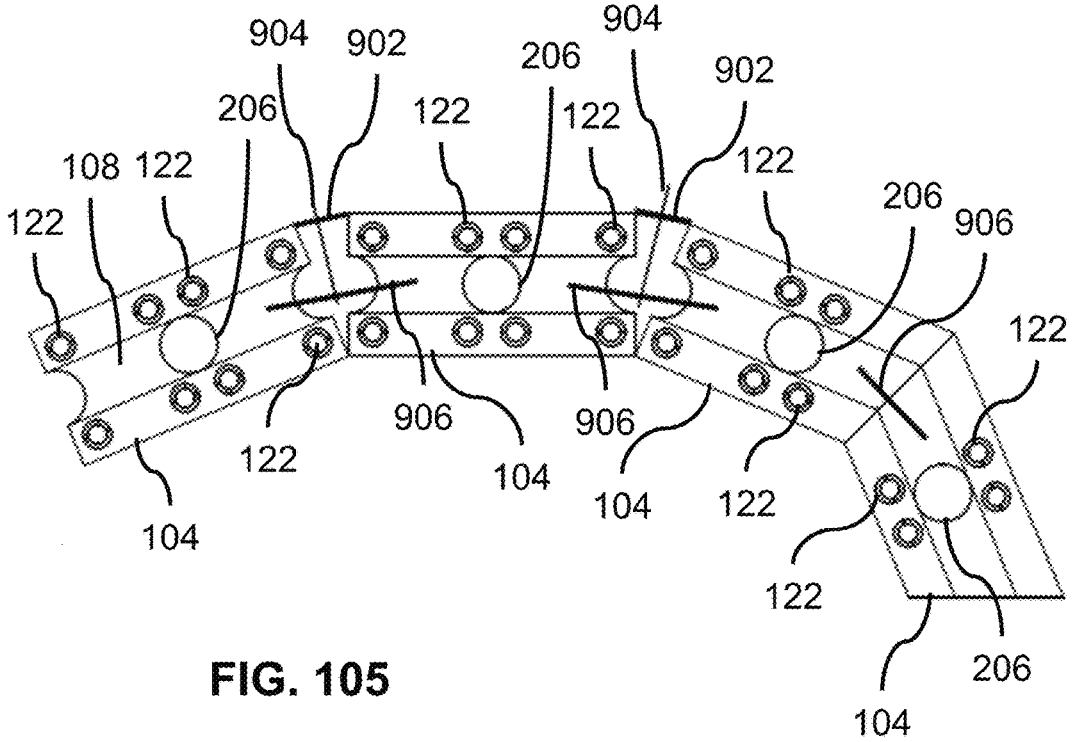
FIG. 105 depicts a view of an embodiment of the combinable modular retaining wall block of FIG. 1.

FIG. 105 depicts a view of an embodiment of the combinable modular retaining wall block 104 of FIG. 1. FIG. 105 depicts a top view.

In accordance with the embodiment as depicted in FIG. 105, the block 104 includes a concave random angle configuration. A rear face of the monolithic retaining wall 102 is filled with the soil that is being retained. It will be appreciated that any angle may be achieved by adjusting the gap at the back side of the monolithic retaining wall 102. Forms 902 are configured to contain concrete. Connectors 904 (also called bolts) fixedly extend from the form 902 to the rebar cage (not depicted but positioned in the horizontal groove 108 of the blocks 104) to improve secured positing of the form 902. A tie 906 (also called a turnbuckle (r or other devices known to persons experienced in the art such as heavy gauge tie wire twisted tight, etc., and any equivalent thereof) is positioned to maintain tension to hold the blocks 104 in place until concrete is poured. The tie 906 may be attached to a lifting loop 124 (as depicted in FIG. 10); the tie 906 is not shown in FIG. 5 for improved viewing clarity.

Figure 106:
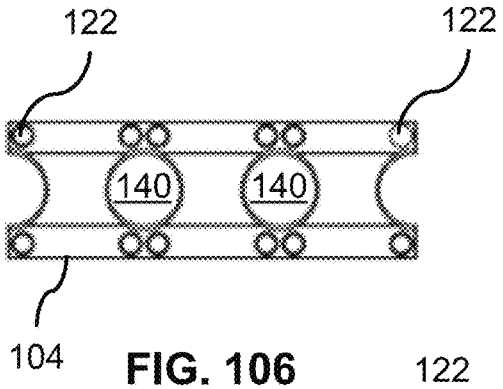
FIGS. 106 to 109 depict views of embodiments of the combinable modular retaining wall block of FIG. 1.
Figure 107:
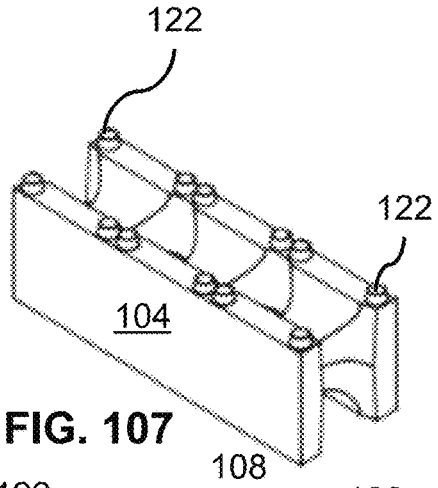
Figure 108:
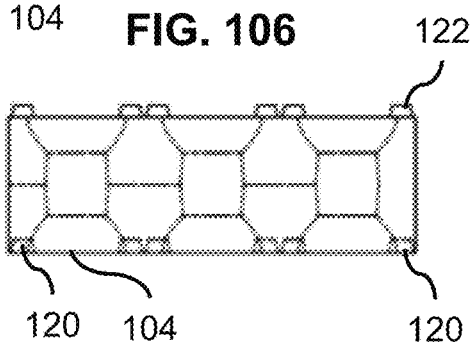
Figure 109:
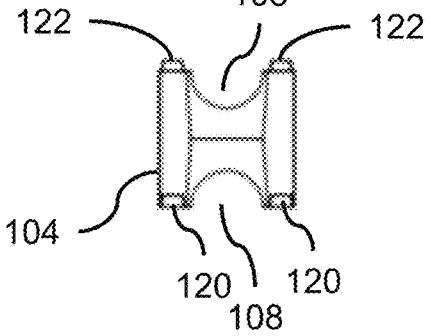

FIGS. 106 to 109 depict views of embodiments of the combinable modular retaining wall block 104 of FIG. 1. FIG. 106 depicts a top view. FIG. 107 depicts a perspective view from the top. FIG. 108 depicts a lateral side view. FIG. 109 depicts an end view.

In accordance with the embodiments as depicted in FIGS. 106 to 109, the block 104 includes an extended block with two tapered instances of the vertical passageway 140. The block 104 includes additional instances of the second interlocking feature 122. This is done in such a way that the block 104 is further extended (to any desired length) with at least one more instances of the vertical passageway 140 defined by the block 104 (to allow design flexibility and overlap interlocking options of the monolithic retaining wall, as depicted in FIG. 7A or FIG. 7B).

Figure 110:
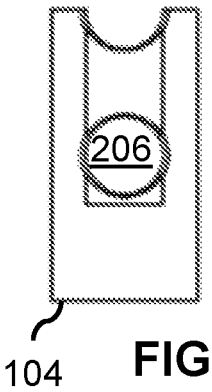
FIGS. 110 to 113 depict views of embodiments of the combinable modular retaining wall block of FIG. 1.
Figure 111:
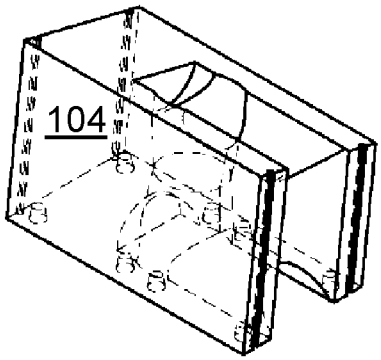
Figure 112:
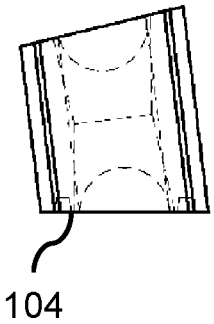
Figure 113:
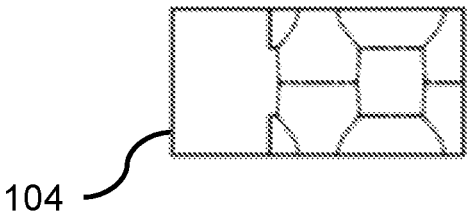

FIGS. 110 to 113 depict views of embodiments of the combinable modular retaining wall block 104 of FIG. 1. FIG. 110 depicts a side view. FIG. 111 depicts a perspective view from the top. FIG. 112 depicts an end view. FIG. 113 depicts a lateral view.

In accordance with the embodiments as depicted in FIGS. 110 to 113, the block 104 includes an arch end block. The block 104 is configured to be positioned at an outside edge of an arch shaped instance of the monolithic retaining wall formation to contain the concrete and provide a visually appealing finished edge.

Figure 114:
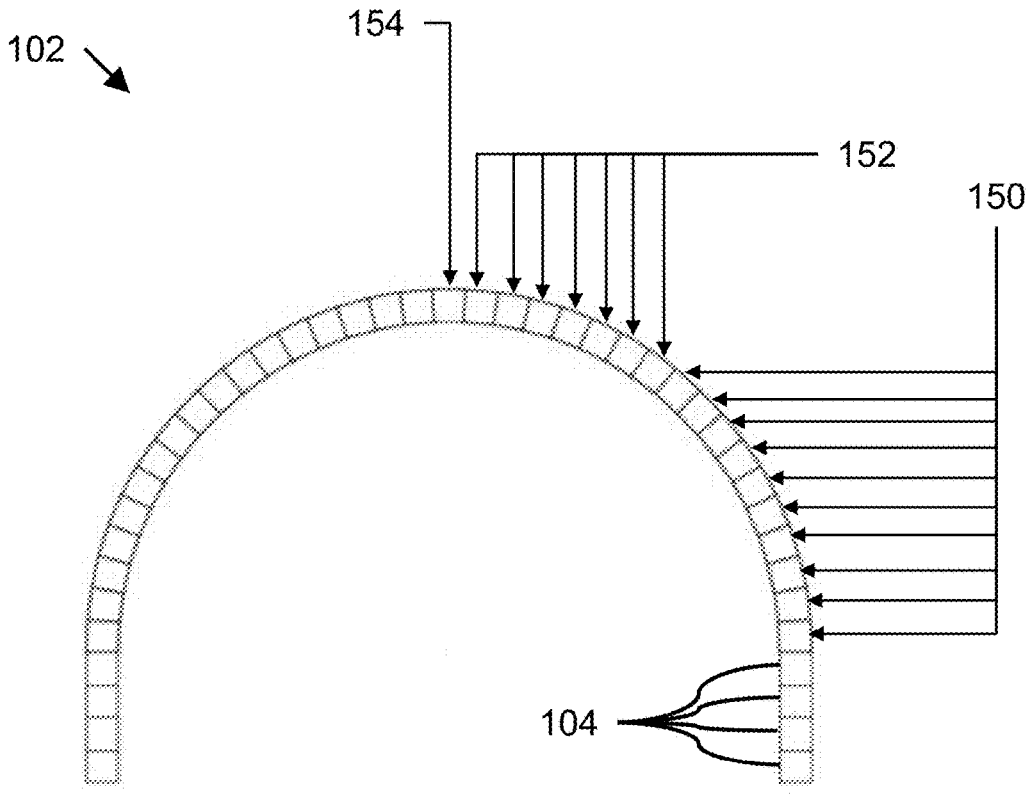
FIG. 114 depicts a view of an embodiment of the combinable modular retaining wall block of FIG. 1.

FIG. 114 depicts a view of an embodiment of the combinable modular retaining wall block 104 of FIG. 1. FIG. 114 depicts an end view.

In accordance with the embodiment as depicted in FIG. 114, the arch shaped instance of the monolithic retaining wall 102 includes the block 104 that is stacked to the desired height and an intermediate arched block that is vertically stacked to a desired height. The monolithic retaining wall 102 further includes at least one instance of an intermediate arched block 150 stacked over the block 104. The arch shaped instance of the monolithic retaining wall 102 further includes at least one instance of an upper arch block 152 stacked over the intermediate arched block 150. The arch shaped instance of the monolithic retaining wall 102 further includes a key block 154 stacked over the upper arch block 152.

Figure 115:
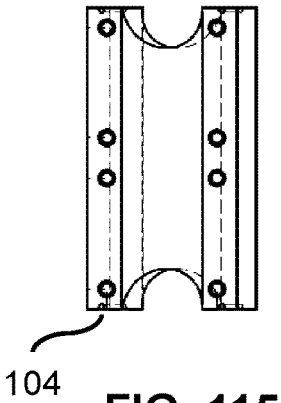
FIGS. 115 to 118 depict views of embodiments of the combinable modular retaining wall block of FIG. 1.
Figure 116:
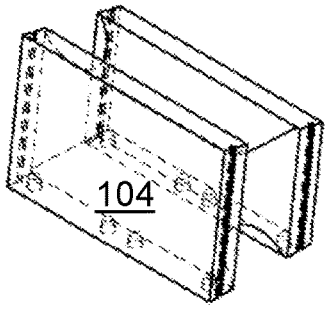
Figure 117:
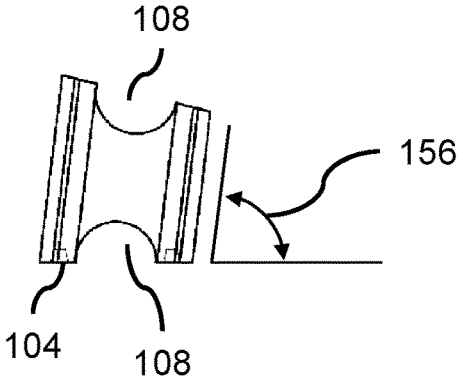
Figure 118:
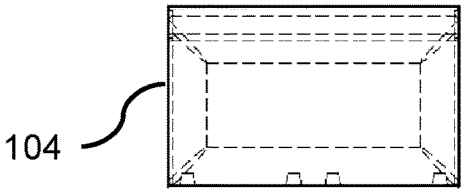

FIGS. 115 to 118 depict views of embodiments of the combinable modular retaining wall block 104 of FIG. 1. FIG. 115 depicts a bottom view. FIG. 116 depicts a perspective view from the top. FIG. 117 depicts an end view. FIG. 118 depicts a top view.

In accordance with the embodiments as depicted in FIGS. 115 to 118, the block 104 includes an arch base block. The block 104 defines a block side angle 156. The block 104 is used for the bottom 30-degrees of arc, at the base of an arch structure (as depicted in FIG. 114). The angle of block sides is determined by the radius of the arc.

FIGS. 119 to 122 depict views of embodiments of the combinable modular retaining wall block 104 of FIG. 1.

Figure 119:
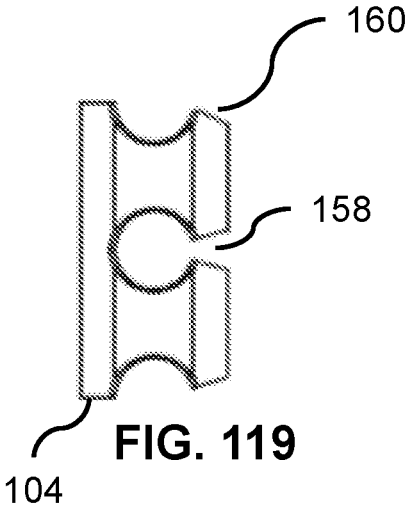
FIGS. 119 to 122 depict views of embodiments of the combinable modular retaining wall block of FIG. 1.
Figure 120:
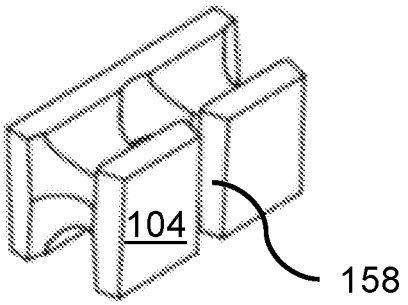
Figure 122:
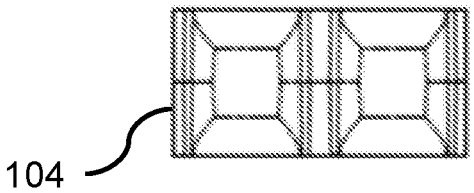
Figure 121:
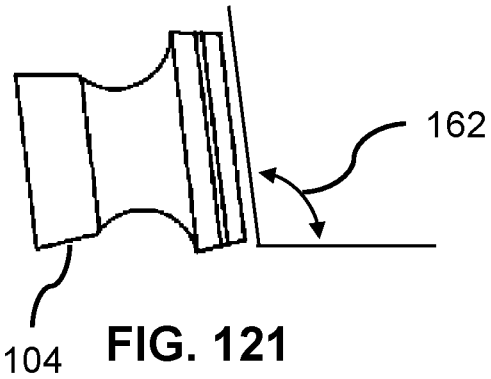

FIG. 119 depicts a side view. FIG. 120 depicts a perspective view from the top. FIG. 121 depicts an end view. FIG. 122 depicts a top view.

In accordance with the embodiments as depicted in FIGS. 119 to 122, the block 104 includes an arch top block. A full slot 158 (full tapered slot) is configured to facilitate placement of concrete. A half slot 160 is combined with half slot on adjacent block form the full slot 158. An angle 162 is defined by the block side of the block 104. The block 104 is used for the top 30-degrees arc when building an arch structure (as depicted in FIG. 114). The block 104 is placed with the full slot 158 on the top to facilitate placing the concrete. The radius of the arch determines the angle of the block sides.

Figure 123:
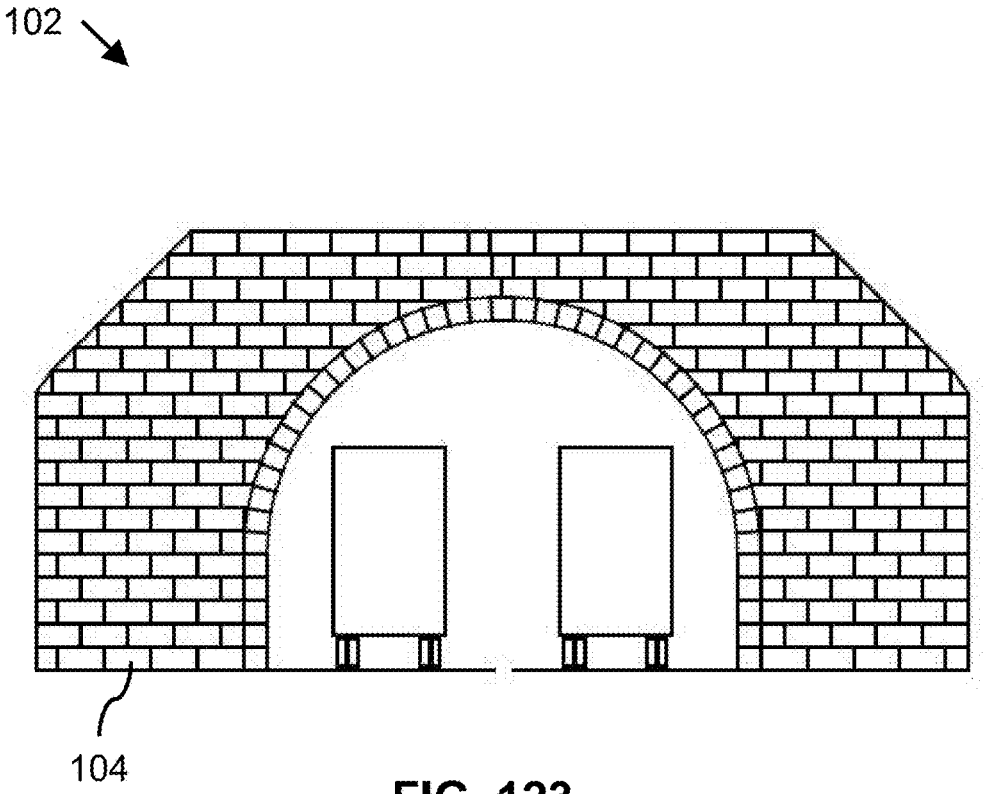
FIG. 123 depicts a view of an embodiment of the combinable modular retaining wall block of FIG. 1.

FIG. 123 depicts a view of an embodiment of the combinable modular retaining wall block 104 of FIG. 1. FIG. 123 depicts a side view.

In accordance with the embodiment as depicted in FIG. 123, the monolithic retaining wall 102 includes an arched-wall assembly. The arch structure is combined with the retaining wall to produce an overpass or bridge. The retaining wall and arch can be tied into the arch by interlacing the rebar cages of each before placing the concrete making a monolithic structure thus increasing the strength and durability of both components.

Figure 124:
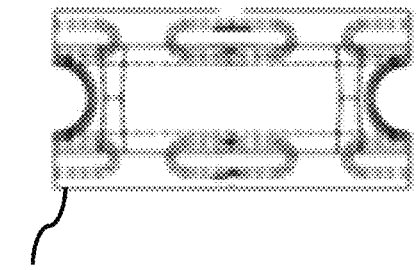
FIGS. 124 to 127 depict views of embodiments of the combinable modular retaining wall block of FIG. 1.
Figure 125:
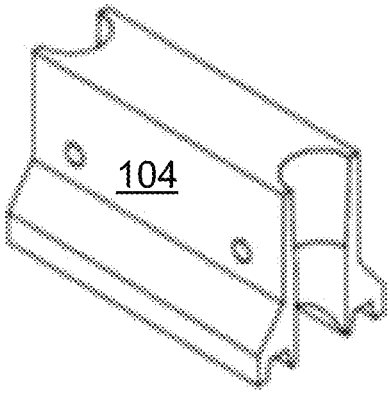
Figure 126:
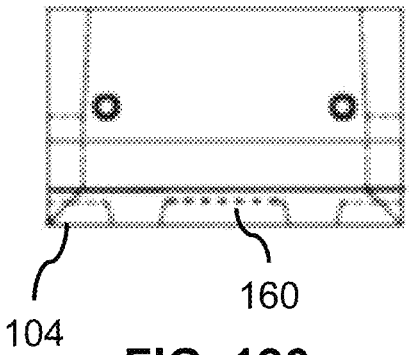
Figure 127:
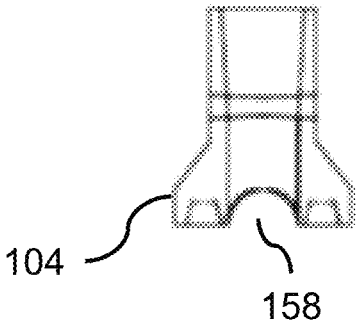

FIGS. 124 to 127 depict views of embodiments of the combinable modular retaining wall block 104 of FIG. 1. FIG. 124 depicts a top view. FIG. 125 depicts a perspective view from the top. FIG. 126 depicts a lateral side view. FIG. 127 depicts an end view.

In accordance with the embodiments as depicted in FIGS. 124 to 127, the block 104 includes a traffic barrier formation. The block 104 includes a full slot 158. The block 104 includes a half slot 160. The traffic barrier block is configured to fit and combine with the retaining wall blocks with the tapered void making a solid mechanical lock when filled with concrete and a rebar cage. A utility line can be run through the voids to provide lighting or sign power. An attachment or base for lamp posts, fence posts, sign posts and any other structure or material can be cast into the voids.

It will be appreciated that the embodiments of the block 104 may be cast with varying lengths, widths and/or height ratios to suite design requirements. Various anchoring devices (know and not depicted) may be cast into any of the embodiments of block 104.

It will be appreciated that the description identifies and describes options and variations of the apparatus 100, regardless of whether the description identifies the options and/or variations of the apparatus 100 by way of explicit terms and/or non-explicit terms. Other options for the apparatus 100 as identified in this paragraph may include any combination and/or permutation of the technical features (assemblies, components, items, devices, etc.) as identified in the detailed description, as may be required and/or desired to suit a particular technical purpose and/or technical function. It will be appreciated, that where possible, any one or more of the technical features and/or any one or more sections of the technical features of the apparatus 100 may be combined with any other one or more of the technical features and/or any other one or more sections of the technical features of the apparatus 100 in any combination and/or permutation. Any one or more of the technical features and/or any one or more sections of the technical features of the apparatus 100 may stand on its own merit without having to be combined with another technical feature. It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus 100 (if so desired) to adjust to manufacturing requirements and still remain within the scope of the invention as described in at least one or more of the claims. This written description uses examples to disclose the invention, including the best mode, and also to enable any person skilled in the art to make and use the invention. The patentable scope of the invention is defined by the claims, and may include other examples that occur to those skilled in the art. Such other examples are within the scope of the claims if they have structural elements that do not differ from the literal language of the claims, or if they include equivalent structural elements with insubstantial differences from the literal language of the claims. It may be appreciated that the assemblies and modules described above may be connected with each other as required to perform desired functions and tasks within the scope of persons of skill in the art to make such combinations and permutations without having to describe each and every one in explicit terms. There is no particular assembly or component that may be superior to any of the equivalents available to the person skilled in the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

combinable modular retaining wall blocks configured to form, in combination, a monolithic retaining wall; and each of the combinable modular retaining wall blocks defining vertical grooves extending along a vertical direction, and horizontal grooves extending along a horizontal direction; and the combinable modular retaining wall blocks configured to form, in combination, the monolithic retaining wall in such a way that:

the monolithic retaining wall defines spaced-apart instances of vertical channels extending vertically through the monolithic retaining wall, and spaced-apart instances of horizontal channels extending horizontally through the monolithic retaining wall, in which at least some of the spaced-apart instances of the horizontal channels intersect at least some of the spaced-apart instances of the vertical channels; and a rebar cage structure is installable in the spaced-apart instances of the vertical channels defined by the monolithic retaining wall and the spaced-apart instances of the horizontal channels defined by the monolithic retaining wall in such a way that the rebar cage structure extends, at least in part, along at least some of the spaced-apart instances of the vertical channels defined by the monolithic retaining wall, and the spaced-apart instances of the horizontal channels defined by the monolithic retaining wall; and hardened concrete is bondable with at least some of the rebar cage structure that is positioned in the spaced-apart instances of the vertical channels defined by the monolithic retaining wall, and the spaced-apart instances of the horizontal channels defined by the monolithic retaining wall; and the hardened concrete is bondable with at least some of the combinable modular retaining wall blocks forming the monolithic retaining wall, in which the hardened concrete was formed by: pouring a concrete slurry into the spaced-apart instances of the vertical channels defined by the monolithic retaining wall and also into the spaced-apart instances of the horizontal channels defined by the monolithic retaining wall in which the rebar cage structure is installed therein, and allowing the concrete slurry to harden in (i) the spaced-apart instances of the vertical channels defined by the monolithic retaining wall, and (ii) the spaced-apart instances of the horizontal channels defined by the monolithic retaining wall in which the rebar cage structure is installed therein; and the hardened concrete, which is bonded with the combinable modular retaining wall blocks forming the monolithic retaining wall, and the rebar cage structure that is positioned in the spaced-apart instances of the vertical channels of the monolithic retaining wall, in combination with the rebar cage structure are configured to bear, in use, application of a combination of (a) a compressive force to the hardened concrete as a result of the weight of the combinable modular retaining wall blocks installed in the monolithic retaining wall, and (b) a vertical tension force to the hardened concrete, in which the vertical tension force is a result of the weight of soil bearing against the monolithic retaining wall, in which the vertical tension force is applicable along the vertical direction extending vertically through the combinable modular retaining wall blocks that form the monolithic retaining wall; and the hardened concrete, which is bonded with the combinable modular retaining wall blocks forming the monolithic retaining wall, and the rebar cage structure that is positioned in the spaced-apart instances of the horizontal channels of the monolithic retaining wall, in combination with the rebar cage structure are configured to bear, in use, a horizontal tension force as a result of the weight of soil bearing against the monolithic retaining wall along the horizontal direction extending horizontally through the combinable modular retaining wall blocks that form the monolithic retaining wall; and wherein the at least one of the combinable modular retaining wall blocks defines a central vertical passageway without being combined with another instance of the at least one of the combinable modular retaining wall blocks, and the central vertical passageway extends, at least in part, through a body of the at least one of the combinable modular retaining wall blocks; and the central vertical passageway extends entirely through the material of the at least one of the combinable modular retaining wall blocks;

the central vertical passageway is entirely formed of, and surrounded by, the material of the at least one of the combinable modular retaining wall blocks; and the rebar cage structure includes a vertically-extending rebar that extends through, and remains aligned along, a central axis extending centrally through the central vertical passageway; and wherein the at least one of the combinable modular retaining wall blocks includes a rock anchor block having a metal reinforcing cage formed therein, and the metal reinforcing cage has at least one anchor tube with endplates cast into the at least one of the combinable modular retaining wall blocks to allow rock anchors to be passed through, and secured to, an outer face; and wherein the at least one of the combinable modular retaining wall blocks includes:

opposite ends that each define vertical grooves extending along a vertical direction along each of the opposite ends thereof; and a top side and a bottom side that each define horizontal grooves extending along a horizontal direction between the opposite ends.

2. The apparatus of claim 1, wherein:

the spaced-apart instances of the vertical channels include a combination of the vertical grooves of neighboring instances of the combinable modular retaining wall blocks placed or positioned in a side-by-side spatial relationship; and the spaced-apart instances of the horizontal channels include the combination of the horizontal grooves of neighboring instances of the combinable modular retaining wall blocks placed in a one above the other spatial relationship.

3. The apparatus of claim 1, wherein:

the rebar cage structure includes:

vertical rebars extending along the vertical direction; and horizontal rebars extending along the horizontal direction; and the vertical rebars extend along the vertical direction through at least some of the respective instances of the spaced-apart instances of the vertical channels; and the horizontal rebars extend along the horizontal direction through at least some of the respective instances of the spaced-apart instances of the horizontal channels.

4. The apparatus of claim 1, wherein:

the concrete slurry is made to flow, at least in part, into the spaced-apart instances of the vertical channels defined by the monolithic retaining wall, and the spaced-apart instances of the horizontal channels defined by the monolithic retaining wall, in such a way that the concrete slurry flows around the rebar cage structure that is installed in the instances of the spaced-apart instances of the vertical channels, and the instances of the spaced-apart instances of the horizontal channels.

5. The apparatus of claim 1, wherein:

a utility pipe is positionable inside any one of:

at least one of the vertical grooves; and at least one of the horizontal grooves; and a passageway that extends, at least in part, through the at least one of the combinable modular retaining wall blocks.

6. The apparatus of claim 1, wherein:

the at least one of the combinable modular retaining wall blocks includes steel reinforcement embedded in a hardened concrete body.

7. The apparatus of claim 1, wherein:

the at least one of the combinable modular retaining wall blocks includes:

a first interlocking feature positioned on a bottom side of the at least one of the combinable modular retaining wall blocks; and a second interlocking feature positioned on a top side of the at least one of the combinable modular retaining wall blocks.

8. The apparatus of claim 7, wherein:

the first interlocking feature of an instance of the at least one of the combinable modular retaining wall blocks is configured to interlock with the second interlocking feature of a neighboring instance of the at least one of the combinable modular retaining wall blocks that is stacked vertically relative to the instance of the at least one of the combinable modular retaining wall blocks.

9. The apparatus of claim 1, further comprising:

a lifting loop affixed to a top section of the at least one of the combinable modular retaining wall blocks, and the lifting loop is configured to facilitate lifting of the at least one of the combinable modular retaining wall blocks by a machine.

10. The apparatus of claim 1, wherein:

the at least one of the combinable modular retaining wall blocks is a half block configured to allow wall length adjustments and to provide an offset to facilitate overlap interlock of other instances of the at least one of the combinable modular retaining wall blocks.

11. The apparatus of claim 1, wherein:

the at least one of the combinable modular retaining wall blocks includes an angled face sloping from the top center of the at least one of the combinable modular retaining wall blocks to the bottom end, and the at least one of the combinable modular retaining wall blocks is combinable with another instance of the at least one of the combinable modular retaining wall blocks to produce a section of the monolithic retaining wall that has an angled wall end.

12. The apparatus of claim 1, wherein:

the at least one of the combinable modular retaining wall blocks is combinable with another instance of the at least one of the combinable modular retaining wall blocks to make a corner greater than 90 degrees.

13. The apparatus of claim 1, wherein:

the at least one of the combinable modular retaining wall blocks includes a sloped end surface that slopes from a top side of the at least one of the combinable modular retaining wall blocks toward a bottom side of the at least one of the combinable modular retaining wall blocks.

14. The apparatus of claim 1, wherein:

the at least one of the combinable modular retaining wall blocks is configured to provide a finished wall end for the monolithic retaining wall.

15. The apparatus of claim 1, wherein:

the at least one of the combinable modular retaining wall blocks includes a take-off T-shaped block.

16. The apparatus of claim 1, wherein:

the at least one of the combinable modular retaining wall blocks includes a corner-shaped block forming a right angle.

17. The apparatus of claim 1, wherein:

the at least one of the combinable modular retaining wall blocks form an arched-wall assembly including a key block and an arch end block spaced apart from the key block.

18. The apparatus of claim 1, wherein:

the at least one of the combinable modular retaining wall blocks includes:

an arch base block defining a block side angle usable for the bottom of an arc at the base of an arch structure; and an arch top block having:

a full slot configured to facilitate placement of concrete; and half slots positioned on opposite lateral ends of the arch top block; and an angle defined by a side of the arch top block.

19. The apparatus of claim 1, wherein:

the at least one of the combinable modular retaining wall blocks includes:

a wedge block configured to slope back in such a way that the monolithic retaining wall is angled to one side and into the soil, and the weight of the monolithic retaining wall is directed toward the soil, to stabilize, at least in part, the monolithic retaining wall; and the wedge block is configured to turn a sloped instance of the monolithic retaining wall back to the horizontal direction.

20. An apparatus, comprising:

a monolithic retaining wall being formed by combinable modular retaining wall blocks; and each of the combinable modular retaining wall blocks defining vertical grooves extending along a vertical direction, and horizontal grooves extending along a horizontal direction, and this is done in such a way that the monolithic retaining wall, which is formed by the combinable modular retaining wall blocks, defines spaced-apart instances of vertical channels extending vertically through the monolithic retaining wall, and spaced-apart instances of horizontal channels extending horizontally through the monolithic retaining wall, in which at least some of the spaced-apart instances of the horizontal channels intersect at least some of the spaced-apart instances of the vertical channels; and a rebar cage structure being installed in the spaced-apart instances of the vertical channels defined by the monolithic retaining wall, and the spaced-apart instances of horizontal channels defined by the monolithic retaining wall, and this is done in such a way that the rebar cage structure extends, at least in part, along at least some of the spaced-apart instances of the vertical channels defined by the monolithic retaining wall, and the spaced-apart instances of the horizontal channels defined by the monolithic retaining wall; and hardened concrete being bonded with at least some of the rebar cage structure that is positioned in (i) the spaced-apart instances of the vertical channels defined by the monolithic retaining wall, and (ii) the spaced-apart instances of the horizontal channels defined by the monolithic retaining wall; and the hardened concrete being bonded with at least some of the combinable modular retaining wall blocks forming the monolithic retaining wall, in which the hardened concrete was formed by: pouring a concrete slurry into the spaced-apart instances of the vertical channels defined by the monolithic retaining wall and also into the spaced-apart instances of the horizontal channels defined by the monolithic retaining wall in which the rebar cage structure is installed therein, and allowing the concrete slurry to harden in (i) the spaced-apart instances of the vertical channels defined by the monolithic retaining wall, and (ii) the spaced-apart instances of the horizontal channels defined by the monolithic retaining wall in which the rebar cage structure is installed therein; and wherein the hardened concrete, which is bonded with the combinable modular retaining wall blocks forming the monolithic retaining wall, and the rebar cage structure that is positioned in the spaced-apart instances of the vertical channels of the monolithic retaining wall, in combination with the rebar cage structure are configured to bear, in use, application of a combination of (a) a compressive force to the hardened concrete as a result of the weight of the combinable modular retaining wall blocks installed in the monolithic retaining wall, and (b) a vertical tension force to the hardened concrete, in which the vertical tension force is a result of the weight of soil bearing against the monolithic retaining wall, in which the vertical tension force is applicable along the vertical direction extending vertically through the combinable modular retaining wall blocks that form the monolithic retaining wall; and wherein the hardened concrete, which is bonded with the combinable modular retaining wall blocks forming the monolithic retaining wall, and the rebar cage structure that is positioned in the spaced-apart instances of the horizontal channels of the monolithic retaining wall, in combination with the rebar cage structure are configured to bear, in use, a horizontal tension force as a result of the weight of soil bearing against the monolithic retaining wall along the horizontal direction extending horizontally through the combinable modular retaining wall blocks that form the monolithic retaining wall; and wherein the at least one of the combinable modular retaining wall blocks defines a central vertical passageway without being combined with another instance of the at least one of the combinable modular retaining wall blocks, and the central vertical passageway extends, at least in part, through a body of the at least one of the combinable modular retaining wall blocks; and the central vertical passageway extends entirely through the material of the at least one of the combinable modular retaining wall blocks;

the central vertical passageway is entirely formed of, and surrounded by, the material of the at least one of the combinable modular retaining wall blocks; and the rebar cage structure includes a vertically-extending rebar that extends through, and remains aligned along, a central axis extending centrally through the central vertical passageway; and wherein the at least one of the combinable modular retaining wall blocks includes a rock anchor block having a metal reinforcing cage formed therein, and the metal reinforcing cage has at least one anchor tube with endplates cast into the at least one of the combinable modular retaining wall blocks to allow rock anchors to be passed through, and secured to, an outer face; and wherein the at least one of the combinable modular retaining wall blocks includes:

opposite ends that each define vertical grooves extending along a vertical direction along each of the opposite ends thereof; and a top side and a bottom side that each define horizontal grooves extending along a horizontal direction between the opposite ends.

21. A method of constructing a monolithic retaining wall, comprising:

spatially positioning combinable modular retaining wall blocks in such a way that the combinable modular retaining wall blocks form the monolithic retaining wall relative to a working surface; and each of the combinable modular retaining wall blocks defining vertical grooves extending along a vertical direction, and horizontal grooves extending along a horizontal direction in such a way that the monolithic retaining wall, which is formed by the combinable modular retaining wall blocks, defines spaced-apart instances of vertical channels extending vertically through the monolithic retaining wall, spaced-apart instances of horizontal channels extending horizontally through the monolithic retaining wall, and at least some of the spaced-apart instances of the horizontal channels intersecting at least some of the spaced-apart instances of the vertical channels extending vertically through the monolithic retaining wall; and installing a rebar cage structure in the spaced-apart instances of the vertical channels defined by the monolithic retaining wall and the spaced-apart instances of the horizontal channels defined by the monolithic retaining wall in such a way that the rebar cage structure extends, at least in part, along at least some of the spaced-apart instances of the vertical channels defined by the monolithic retaining wall, and the spaced-apart instances of the horizontal channels defined by the monolithic retaining wall; and forming the monolithic retaining wall by pouring a concrete slurry into the spaced-apart instances of the vertical channels defined by the monolithic retaining wall and also into the spaced-apart instances of the horizontal channels defined by the monolithic retaining wall in which the rebar cage structure is installed, at least in part, therein;

waiting for the concrete slurry to harden into hardened concrete in such a way that:

the hardened concrete becomes bonded with at least some of the combinable modular retaining wall blocks forming the monolithic retaining wall, and the rebar cage structure that is positioned in the spaced-apart instances of the vertical channels defined by the monolithic retaining wall, and the spaced-apart instances of the horizontal channels defined by the monolithic retaining wall; and the hardened concrete, which becomes bonded with at least some of the combinable modular retaining wall blocks forming the monolithic retaining wall, and the rebar cage structure that is positioned in the spaced-apart instances of the vertical channels of the monolithic retaining wall, is configured to bear, in use, application of a combination of (a) a compressive force to the hardened concrete as a result of the weight of the combinable modular retaining wall blocks installed in the monolithic retaining wall, and (b) a vertical tension force to the hardened concrete, in which the vertical tension force is a result of the weight of soil bearing against the monolithic retaining wall, in which the vertical tension force is applicable along the vertical direction extending vertically through the combinable modular retaining wall blocks that form the monolithic retaining wall; and the hardened concrete, which becomes bonded with at least some of the combinable modular retaining wall blocks forming the monolithic retaining wall, and the rebar cage structure that is positioned in the spaced-apart instances of the horizontal channels of the monolithic retaining wall, in combination with the rebar cage structure are configured to bear, in use, a horizontal tension force as a result of the weight of soil bearing against the monolithic retaining wall along the horizontal direction extending horizontally through the combinable modular retaining wall blocks that form the monolithic retaining wall; and wherein the at least one of the combinable modular retaining wall blocks defines a central vertical passageway without being combined with another instance of the at least one of the combinable modular retaining wall blocks, and the central vertical passageway extends, at least in part, through a body of the at least one of the combinable modular retaining wall blocks; and the central vertical passageway extends entirely through the material of the at least one of the combinable modular retaining wall blocks;

the central vertical passageway is entirely formed of, and surrounded by, the material of the at least one of the combinable modular retaining wall blocks; and the rebar cage structure includes a vertically-extending rebar that extends through, and remains aligned along, a central axis extending centrally through the central vertical passageway; and wherein the at least one of the combinable modular retaining wall blocks includes a rock anchor block having a metal reinforcing cage formed therein, and the metal reinforcing cage has at least one anchor tube with endplates cast into the at least one of the combinable modular retaining wall blocks to allow rock anchors to be passed through, and secured to, an outer face; and wherein the at least one of the combinable modular retaining wall blocks includes:

opposite ends that each define vertical grooves extending along a vertical direction along each of the opposite ends thereof; and a top side and a bottom side that each define horizontal grooves extending along a horizontal direction between the opposite ends.

* * * * *